US011047160B2

(12) United States Patent
Sisto

(10) Patent No.: US 11,047,160 B2
(45) Date of Patent: Jun. 29, 2021

(54) SLIDING DOOR MOUNTING SYSTEM

(71) Applicant: SALTO, LLC, Philadelphia, PA (US)

(72) Inventor: Salvatore Sisto, East Brunswick, NJ (US)

(73) Assignee: SALTO, LLC

( * ) Notice: Subject to any disclaimer, the term of this patent is extended or adjusted under 35 U.S.C. 154(b) by 139 days.

(21) Appl. No.: 16/360,780

(22) Filed: Mar. 21, 2019

(65) Prior Publication Data

US 2020/0040631 A1 Feb. 6, 2020

Related U.S. Application Data

(60) Provisional application No. 62/713,717, filed on Aug. 2, 2018, provisional application No. 62/649,033, filed on Mar. 28, 2018.

(51) Int. Cl.
*E05D 15/06* (2006.01)

(52) U.S. Cl.
CPC ..... *E05D 15/0652* (2013.01); *E05D 15/063* (2013.01); *E05D 15/0643* (2013.01); *E05D 15/0647* (2013.01); *E05Y 2900/132* (2013.01)

(58) Field of Classification Search
None
See application file for complete search history.

(56) References Cited

U.S. PATENT DOCUMENTS 1,540,027 A * 6/1925 McQueen ..... E05D 15/0643 16/88
1,670,455 A * 5/1928 Kuhn ..... E05D 15/0643 16/88
1,688,191 A * 10/1928 Kuhn ..... E05D 15/0643 16/94 R
1,832,203 A * 11/1931 Gussack ..... E05D 15/0643 16/97
2,048,845 A * 7/1936 Danley ..... E05D 15/0643 16/87 R (Continued)

FOREIGN PATENT DOCUMENTS

DE 29801869 U1 * 3/1998 ..... E05D 15/0652
DE 102009008207 A1 * 8/2010 ..... A47H 15/02

OTHER PUBLICATIONS

Specialized Linear Motion Rolling Guides—https://web.archive.org/web/20160712084546/https://www.ikont.com/linear-guides/specialized-linear-motion-rolling-guides/.*

*Primary Examiner* — Marcus Menezes
(74) *Attorney, Agent, or Firm* — Belles Katz LLC

(57) ABSTRACT

A door mounting system for sliding translation of a door in one embodiment may include a longitudinally elongated support rail defining a mounting axis, a pair of wall mounts rigidly anchoring the support rail to a support surface, a door bracket slideably movable along the support rail, a door supported by the door bracket in a suspended manner, and a linear roller bearing disposed at an interface between the door bracket and support rail to facilitate movement of the door bracket along the support rail. The door is linearly translatable along the support rail in operation between open and closed positions. In one embodiment, an anti-sway clip disposed on the door bracket defines a stop surface configured to engage the support rail to arrest swaying motion of the door if a force is inadvertently applied to the door acting in a plane oriented transversely to the mounting axis.

22 Claims, 22 Drawing Sheets

(56) References Cited

U.S. PATENT DOCUMENTS

| | | | | | |
|---|---|---|---|---|---|
| 2,728,101 | A * | 12/1955 | Cowdroy | E05D 15/0643 | 16/88 |
| 3,601,926 | A * | 8/1971 | Weiher | E05D 15/0643 | 49/409 |
| 4,112,539 | A * | 9/1978 | Hagen | E05D 15/0643 | 16/88 |
| 4,503,637 | A * | 3/1985 | Parente | E05D 15/06 | 49/118 |
| 4,716,693 | A * | 1/1988 | Webster | E05D 15/1065 | 49/410 |
| 6,830,299 | B2 * | 12/2004 | Henriott | E05D 15/0643 | 312/139.2 |
| 2015/0252603 | A1 * | 9/2015 | Cianetti | E06B 3/4645 | 49/119 |
| 2017/0067276 | A1 | 3/2017 | Apodaca | | |
| 2017/0298669 | A1 | 10/2017 | Boring et al. | | |
| 2018/0355665 | A1 * | 12/2018 | Seuberling | E06B 7/2307 | |

* cited by examiner

SLIDING DOOR MOUNTING SYSTEM

CROSS-REFERENCE TO RELATED APPLICATIONS

The present application claims the benefit of priority to U.S. Provisional Application No. 62/649,033 filed Mar. 28, 2018, and U.S. Provisional Application No. 62/713,717 filed Aug. 2, 2018; the entireties of which are incorporated herein by reference.

BACKGROUND OF THE INVENTION

The present invention generally relates to doors, and more particularly to a door support and mounting assembly for mounting doors in a suspended sliding manner.

Sliding doors such as barn style door or similar are mounted in a suspended and linear sliding manner from an overhead support system of some type. This contrasts to conventional door mounting hardware which pivotably mount the doors via hinges to the vertical door jambs that define the doorway. Sliding doors do not consume the same room space necessary to operate a pivotably mounted door, and are therefore beneficial in tight spaces or other situations where a slideable door mounting is a desirable option. There are however drawbacks to current mounting hardware for sliding doors.

Hardware for mounting barn style doors typically use a fixed rail track and relatively large diameter pulley wheels which are attached to the door and roll along the rail as the door is opened or closed. U.S. Patent Application Publication No. 2017/0067276 discloses such an arrangement as an example. When the door is pushed in a direction along the rail, these large diameter pulleys are conducive for imparting significant momentum to the door once it starts rolling in a somewhat uncontrolled manner. The doors may therefore strike the ends of the track with considerable force causing damage and/or hardware mounting the track to the wall.

Another drawback to suspended barn style door mounting systems is a lack of means to resistant the door from moving and swaying in and out in a plane transverse to the direction of travel when a user pushes or leans against the large front/back side of the door. This can push the door off the rail and/or cause damage to the building structure.

In addition, yet another drawback is that the mounting hardware for suspended sliding doors is sometimes bulky and unrefined in ornamental appearance, thereby limiting application of such installations to situations where aesthetics is not an overriding consideration.

Improvements are desired in suspended sliding door mounting hardware.

SUMMARY OF THE INVENTION

Exemplary embodiments of the present invention provide a mounting system for hanging a door in a suspended and sliding "barn style" manner from the building structure that overcomes the shortcomings of prior door mounting hardware. The door mounting system disclosed herein has improved aesthetics while including features that provide smooth operation and sufficient structural strength for hanging the door. Advantageously, the present door mounting system further includes provisions which reduce the rolling momentum of the door and prevents sway in a plane transverse to the door's direction of travel. The mounting system may variously be used with door systems having a single or double operating doors. In addition, the mounting system may be used with any type of sliding door in various environments and applications such as shower doors, closet doors, interior or exterior doors, and others.

In one non-limiting embodiment, a door mounting system for sliding translation of a door includes a horizontally/longitudinally elongated support rail, a pair of wall mounts such as standoffs rigidly anchoring the support rail to a vertical support surface, a door bracket movably engaging the support rail, and a door supported by the door bracket in a suspended manner, wherein the door is linearly translatable along the support rail. The mounting system may further comprise a linear needle roller bearing disposed at an interface between the door bracket and the support rail to facilitate sliding movement of the door bracket along the support rail and/or a nylon bearing sheet attached to the door bracket and slideably engaging a side surface of the support rail. The door bracket may include a hook-shaped hanger and an anti-sway bracket in one embodiment which is configured to arrest movement of the door in a plane transverse to the door's direction of travel. In one construction, the support rail, door bracket, and mounting standoffs may be formed of stainless steel for moist operating environments such as bathrooms.

In one aspect, a door mounting system for sliding translation of a door includes: a longitudinally elongated support rail defining a horizontally oriented mounting axis; a pair of wall mounts rigidly anchoring the support rail to a vertical support surface; a door bracket movably engaging the support rail; a door supported by the door bracket in a suspended manner; and a linear roller bearing disposed at an interface between the door bracket and support rail to facilitate movement of the mounting bracket along the support rail; wherein the door is linearly translatable along the support rail.

According to another aspect, a door mounting system for sliding translation of a door includes: a longitudinally elongated support rail defining a mounting axis; a pair of wall mounts rigidly anchoring the support rail to a vertical support surface; a door bracket movably engaging the support rail, the door bracket including a pair of open ends and rearwardly open channel extending between the ends, the channel slideably receiving the support rail therein; a door supported by the door bracket in a suspended manner; and a linear roller bearing disposed at an interface between the door bracket and support rail inside the channel to facilitate movement of the mounting bracket along the support rail; wherein the door is linearly translatable along the support rail via rolling engagement between the roller bearing and the door bracket.

According to another aspect, a method for using a mounting system for sliding translation of a door includes: providing a longitudinally elongated support rail defining a mounting axis, a pair of elongated wall mounts rigidly attached to the support rail, a door bracket including an opposing pair of open ends and a rearwardly open channel extending between the ends, and a linear roller bearing disposed inside the channel; attaching the door bracket to a door; anchoring the support rail to a vertical support surface of a building; lifting the door with attached door bracket; inserting the support rail through the open ends of the door bracket into the channel; engaging the linear roller bearing with a top surface of the support rail; and sliding the door in one of two direction on the support rail.

In some embodiments, the method may further include: the door bracket further including an anti-sway clip; applying a lateral transverse force against the door; and engaging a stop surface of the anti-sway clip with the support rail to arrest motion of the door in a plane transverse to the mounting axis.

In yet other embodiments, the method may further include: the linear roller bearing having a U-shaped body comprising a top wall and at least one lateral sidewall extending downwards from the top wall, the top wall including a plurality of top needle rollers engaging the top surface of the support rail, and the at least one lateral sidewall including a plurality of lateral needle rollers oriented transversely to the top needle rollers; and the step of applying the lateral transverse force against the door further engages an upper rear surface of the support rail with the lateral needle rollers and the anti-sway clip engages a lower rear surface of the support rail to arrest motion of the door in a plane transverse to the mounting axis.

In yet other embodiments, the method may further include: the linear roller bearing having a U-shaped body comprising a top wall and at least one sidewall extending downwards from the top wall, the top wall including a plurality of top needle rollers engaging the top surface of the support rail, and the at least one sidewall including a plurality of lateral needle rollers oriented transversely to the top needle rollers; applying a lateral transverse force against the door; and engaging a rear surface of the support rail with the lateral needle rollers to arrest motion of the door in a plane transverse to the mounting axis.

In another aspect, a roller bearing includes: a U-shaped body comprising a top wall and a pair of lateral sidewalls extending downwards from the top wall; the top wall including a plurality of top needle rollers configured and arranged to engage a corresponding first planar support surface of a support structure; the sidewalls each including a plurality of lateral needle rollers configured and arranged to engage corresponding second and third planar support surfaces of the support structure which are each oriented perpendicularly to the first planar support surface.

BRIEF DESCRIPTION OF THE DRAWINGS

The features of the exemplary embodiments will be described with reference to the following drawings in which like elements are labeled similarly, and in which.

Figure 1:
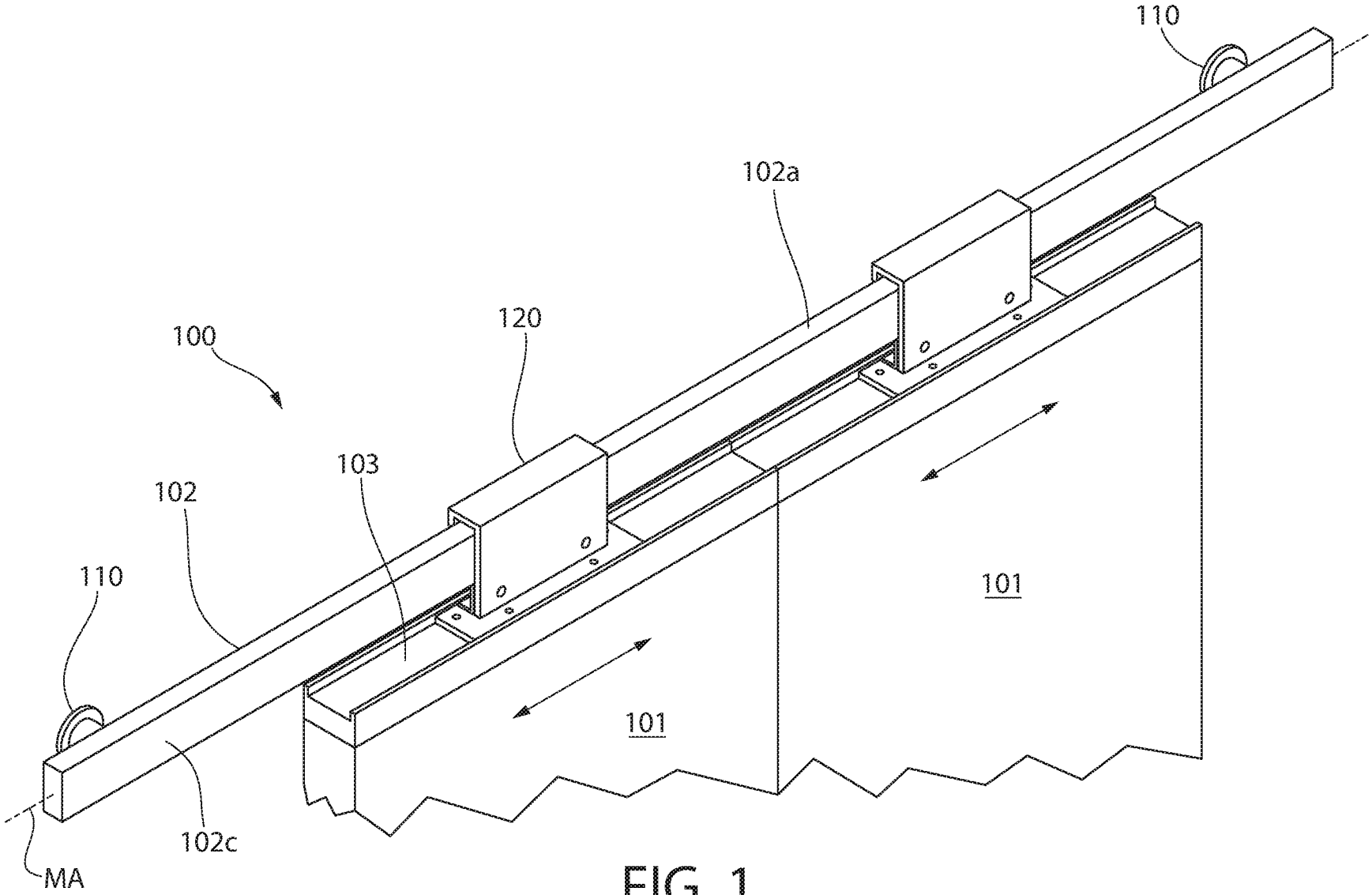
FIG. 1 is a perspective view of a sliding door mounting system according to an embodiment of the present disclosure.
Figure 2:
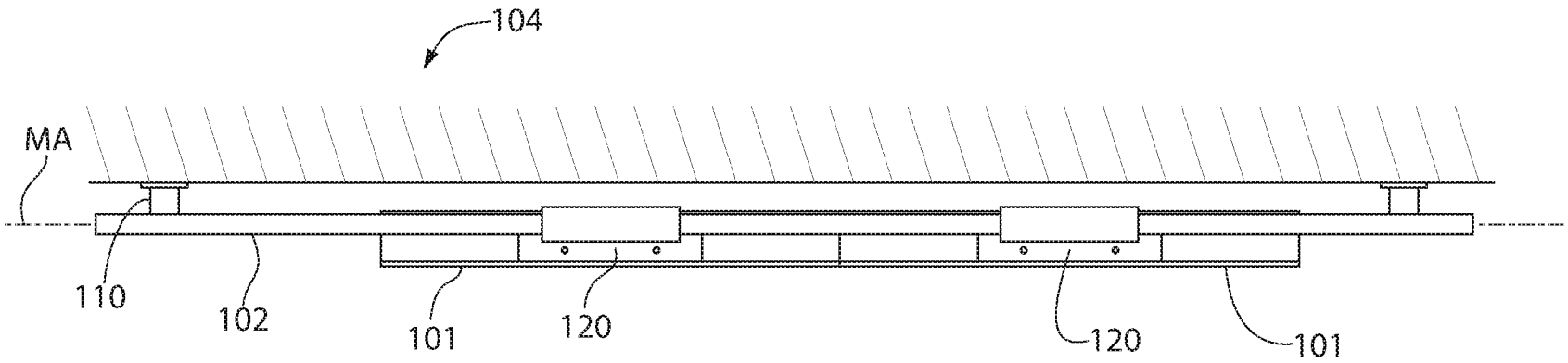
FIG. 2 is a top view thereof.
Figure 3:
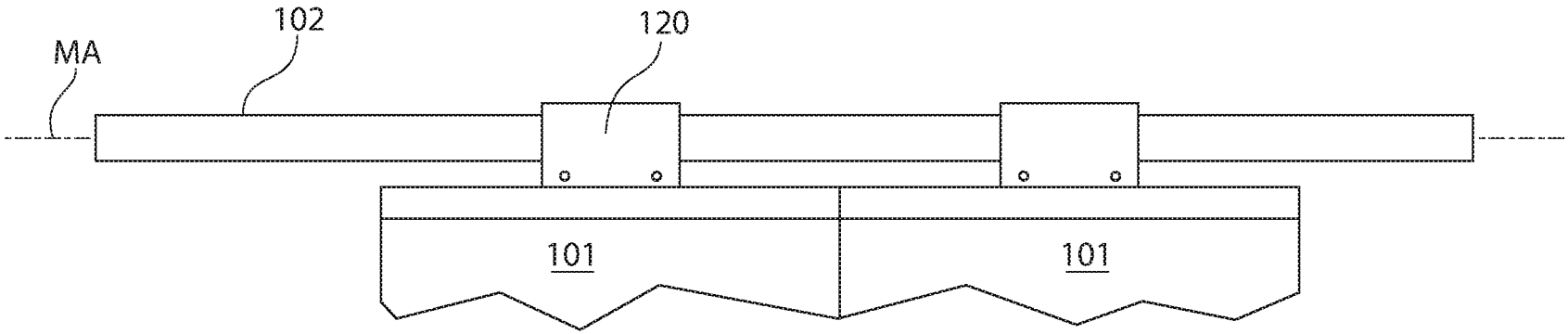
FIG. 3 is a front view thereof.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION OF THE INVENTION

The features and benefits of the present disclosure are illustrated and described herein by reference to exemplary ("example") embodiments. This description of exemplary embodiments is intended to be read in connection with the accompanying drawings, which are to be considered part of the entire written description. Accordingly, the present disclosure expressly should not be limited to such embodiments illustrating some possible non-limiting combination of features that may exist alone or in other combinations of features; the scope of the claimed invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "lateral," "longitudinal," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "coupled," "affixed," "connected," "interconnected," and the like refer to a relationship wherein structures are secured or attached to one another either directly or indirectly through intervening structures, as well as both movable or rigid attachments or relationships, unless expressly described otherwise in a more limiting manner.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

FIGS. 1-4 show one non-limiting embodiment of a sliding door mounting system 100 according to the present disclosure, which in this case controls operation of a double door system. It will be appreciated that in other embodiments, the door mounting system may instead control operation of a single sliding door.

The door mounting system 100 generally includes a support rail 102, one or more wall mounts such as mounting standoffs 110 for anchoring the support rail to a vertical support surface 104 in the illustrated embodiment, and at least one door bracket 120 for each of two doors 101 which are configured for mounting to the top rail 103 of the doors. Support rail 102 provides a track for the sliding door 101. The support rail 102 has a body which is horizontally elongated in length and defines a horizontal longitudinal mounting axis MA of the door mounting system for convenience of reference. Mounting axis MA defines a direction or path of travel of sliding doors 101. The support rail 102 may have a rectilinear configuration in one embodiment as shown; however, other polygonal and non-polygonal shapes may be used. In the non-limiting illustrated embodiment, support rail 102 has a rectangular prismatic configuration with a corresponding rectangular transverse cross section. Support rail 102 may include a combination of planar or flat surfaces including a horizontal top surface 102*a*, opposing horizontal bottom surface 102*b*, vertical front surface 102*c*, and opposite vertical rear surface 102*d* as shown. The support rail 102 may be hollow or solid in construction depending on the required weight of the door to be supported. A suitable metal such as without limitation steel (including stainless steel), aluminum, titanium, or others may be used for the support rail. The support rail has a length sufficient to accommodate the desired full range of motion for the double doors 101 to provide a fully open position and access to and through the doorway.

The mounting standoffs 110 each include a fixed end 113 fixedly coupled to the rear surface 102*d* of the support rail 102 and an opposite free mounting end 114 configured for anchoring to a vertical support surface 104 such as a wall, beam, joist, stud, or any other structural support surface of the building structure. The standoffs 100 extend perpendicularly from the support rail 102 and space the rail horizontally/laterally apart from the support surface by a clearance distance. In one embodiment, at least two standoffs may be provided. Additional standoffs 110 can be provided for added support depending on the weight of the door(s) 101 and range of motion needed. The standoffs 110 are arranged so as to not interference with the sliding action of the door. Each standoff 110 may have an elongated body or shaft which may be cylindrical in one embodiment with circular cross section; however, other non-polygonal or polygonal shapes including rectilinear may be used. The standoffs 110 may be hollow or solid in construction similarly to the support rail depending on the required weight of the door to be supported. The mounting end 114 may comprise an enlarged mounting plate 112 configured for anchoring to the wall or support surface 104 of the building structure. In one embodiment, the mounting plate 112 may be dimensionally enlarged (e.g. diametrically in the present configuration) relative to the cylindrical shaft 111 of the standoff 110 for added support and attachment to the support surface 104. The mounting plate 112 may be oriented perpendicularly to the cylindrical shaft 111 and can include holes for using threaded fasteners to anchor the standoff to the wall. Although a circular mounting plate is shown, other non-polygonal or polygonal shapes (e.g. hexagonal, octagonal, square, rectangular, etc.) may be used which need not match the cross-sectional shape of the shaft 111. A suitable metal such as without limitation steel, aluminum, titanium, or others may be used for the standoff assemblies.

Although a door system comprising two sliding doors and support rail with two standoffs is shown, the same system may be used for mounting a single door which would comprises only one of the doors shown in FIG. 1 sufficient in width to fully cover and close the doorway. Regardless of the number of doors 101 provided in the door system, each door may have an associated single or dual door brackets 120 for mounting the door in a suspended sliding manner from the support rail depending on the weight and size of the door(s). In addition, it bears noting that the support rail 102 may instead be mounted to a horizontal support surface such as a ceiling or other overhead structure in which case the standoffs 110 are vertically oriented and attached to the top surface 102*a* of the rail.

Figure 16:
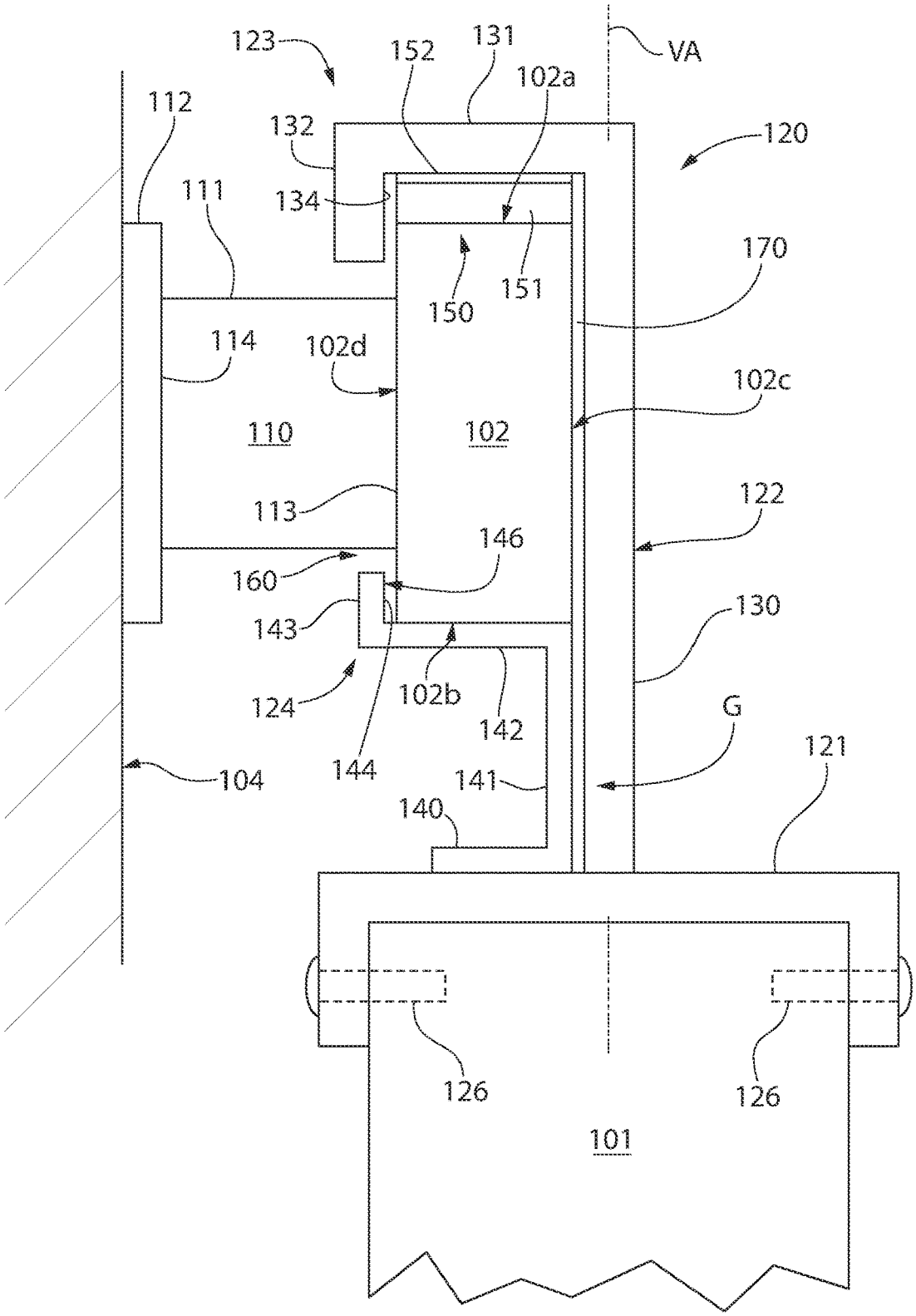
FIG. 16 is an alternative embodiment of a base plate of the door mounting systems of FIGS. 1 and 5.

FIGS. 9-14 show the door brackets 120 in additional detail. Referring generally to FIGS. 1-4 and 9-14, the door brackets 120 which are attached to the doors are the movable component of the door mounting system 100 while the support rail 102 rigidly attached to the vertical support surface wall 104 is the fixed component. The door brackets 120 are thus slideably/rollingly mounted to support rail and include features which enhance smooth linear translation and operation of the door. In one embodiment, each door bracket 120 may be a compound structure including a generally horizontal door mount base plate 121, a hanger 122 having a recurvant hooked end 123 for engaging the support rail, and an anti-sway clip 124. The anti-sway clip 124 and hanger 122 may each be separately attached to the base plate 121 as shown. The base plate 121 is configured for mounting to the top rail 103 of the door(s) 101. Other than the top rail 103 which preferably is solid in construction, the remainder of the door beneath this rails may be substantially hollow or solid. In the illustrated embodiment, the base plate 121 may comprise a flat horizontal metal plate which is configured for attaching to the top rail of the door. A plurality of fastener holes 125 may be provided in the base plate for securing the mounting bracket 120 to the door 101 with threaded fasteners 126. For aesthetics, a channel 127 may optionally be routed or otherwise formed in the top rail 103 of the door 101 so that the base plate 121 is recessed and not visible to the user in some embodiments. In other possible embodiments, the base plate 121 may be shaped as a clevis having an inverted U-shape which slips over the top rail of the door with parallel portions or arms of the clevis engaging the front and rear surfaces of the door via fasteners (see, e.g. FIG. 16). The shape of the base plate 121 and method of attachment to the top rail 103 of door 101 is not limiting of the invention. Any type of door may be used with the door bracket, including for example without limitation wooden doors, composite doors, metal doors, glass doors with metal or wooden top rails for mounting the door bracket, or other.

The hook-shaped hanger 122 of door bracket 120 may generally be considered to have a substantially inverted J-shaped configuration in one embodiment. Hanger 122 includes a vertical front wall section 130 attached to the base plate 121 and extending upwards therefrom, a horizontal top wall section 131 extending perpendicularly and laterally therefrom, and a downward turned vertical rear first flange wall section 132 extending perpendicular and downwardly therefrom. In one embodiment, the vertical wall section 130 of hanger 122 may be centered on the base plate 121. The centerline of wall section 130 defines a vertical axis VA of the mounting bracket 120, which is transversely and perpendicularly oriented to the longitudinal mounting axis MA of the support rail 102. The vertical axis may be laterally offset from the mounting axis. The hanger wall sections 130-132 may be formed as integral parts of a unitary monolithic metal plate-like structure which is cast, extruded, forged, machined, and/or otherwise formed into the configuration shown. The base plate 121 may be integrally formed with and as part of the monolithic hanger 122 in some embodiments. In other embodiments, the hanger 122 and base plate 121 assembly may have a welded construction wherein some or all of the hanger wall sections are welded together to form an integral construction.

The downward turned rear first flange wall section 132 of the hanger 122 has a shorter vertical height than the vertical wall section 130. The height vertical section added to the thickness of the base plate 121 defines a height of the door bracket 120. The first flange wall section 132 is spaced horizontally/laterally apart from and parallel to the vertical wall section 130 and defines downwardly open interior upper recess 134 beneath the top wall section 131 for receiving the upper portion of the support rail 102 and a flat linear needle roller bearing 150 assembly (see, e.g. FIGS. 4 and 15), as further described herein.

The anti-sway clip 124 may generally be considered to have a substantially C-shaped configuration in one embodiment. The anti-sway clip includes a horizontal bottom wall section 140 attached to the base plate 121 of the door bracket 120, a vertical wall section 141 extending perpendicularly and upwards therefrom, a top wall section 142 extending perpendicularly and horizontally/laterally therefrom, and an upward turned second flange wall section 143 extending perpendicularly upwardly therefrom. Similarly to the hanger 122, the wall sections 140-143 of the anti-sway clip 124 may be formed as integral parts of a unitary monolithic metal plate structure which is cast, extruded, forged, machined, and/or otherwise formed into the configuration shown. The upward turned second flange wall section 143 may have a shorter vertical height than the vertical wall section 141 of the anti-sway clip. The second flange wall section 143 is spaced horizontally/laterally apart from the vertical wall section 141 and defines an interior lower recess 144 above the bottom wall section for receiving the lower portion and bottom wall of the support rail (see, e.g. FIG. 4).

As shown, in one embodiment the anti-sway clip 124 may be shorter in height than the hook-shaped hanger 122 and/or have a horizontal/longitudinal length which is coextensive to the length of hanger. The base plate 121 of the hanger may have the same or a greater length than the hanger 122 and anti-sway clip 124 to provide a larger purchase area for door fasteners 126.

The hanger 122 and anti-sway clip 124 collectively define a rearwardly open horizontal extending cavity or channel 160 configured for slideably receiving the support rail 102 therein. The rear opening of the channel 160 has a height defined between the first and second flange wall sections 132, 143 of the hanger and anti-sway clip respectively which is smaller than the height of the support rail 102 as shown in FIG. 1. This prevents the support rail 102 from being laterally/horizontally withdrawn from the channel 160 in a direction transverse to the longitudinal mounting axis MA of the mounting assembly and captures the support rail in the channel. During assembly of the door mounting system 100, the support rail 102 may be inserted in a direction parallel to the horizontal/longitudinal mounting axis MA into the channel 160 through one of the two open ends 148 of the bracket 120.

Advantageously, the second flange wall 143 of the anti-sway clip 124 prevents the door 101 from moving or swaying/swinging rearwards in a plane transverse to the sliding direction of the door and longitudinal mounting axis MA if inadvertently pushed against by a user. Flange wall 143 of anti-sway clip 124 defines a stop surface 146 facing inwards towards channel 160. Stop surface 146 is arranged to engage the rear surface 102*d* of the support rail 102 if the user inadvertently pushes door 101 in an outward forward direction away from the vertical support surface 104 (e.g. wall) in the plane transverse to the mounting axis MA. This arrests undesired swaying motion of the door 101 and prevents damage to the vertical support surface such as a wall behind the door when the door 101 is in a partially or fully open position, or edges of the adjacent doorway when in a closed position. It bears noting that the combination of the hanger 122 and anti-sway clip 124 of the door bracket 120 via the first and second flange wall sections 132, 143 provide fully guided motion of the door 101 along the support rail 102 without the need for any additional or separate type of guide elements which are not part of the door bracket 120.

Figure 4:
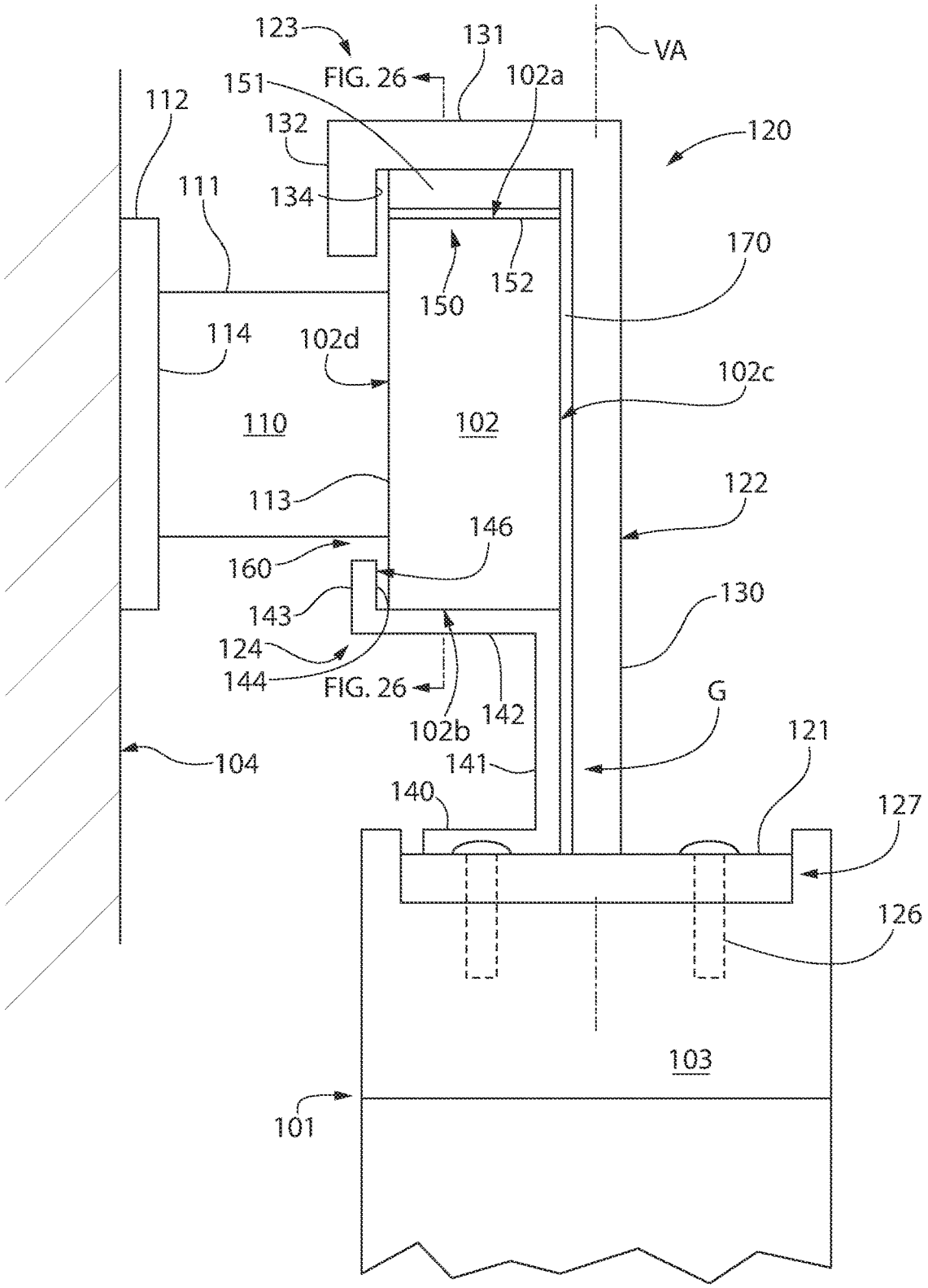
FIG. 4 is an end view thereof.
Figure 5:
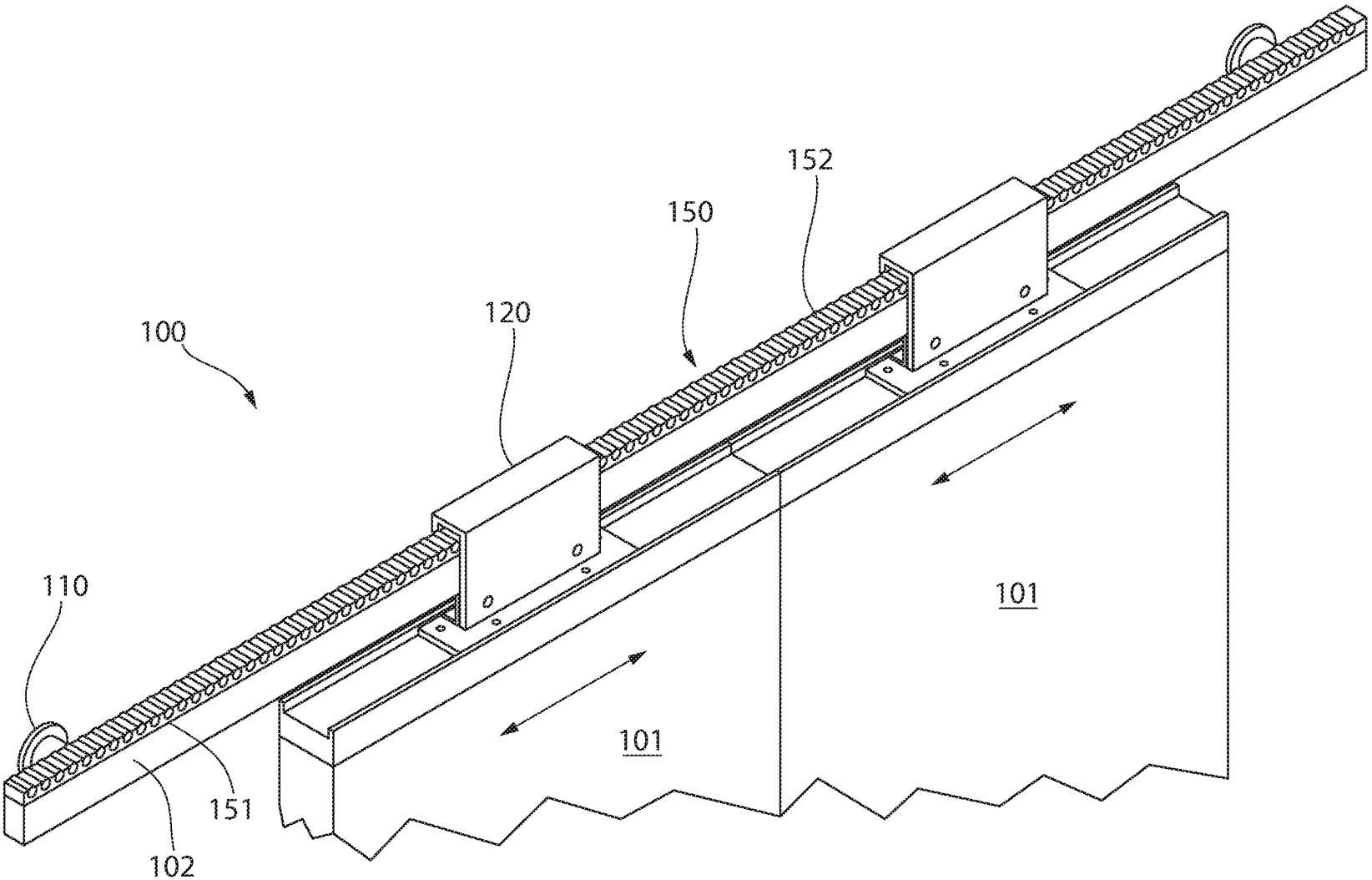
FIG. 5 is a perspective view of an alternative embodiment of a sliding door mounting system according to the present disclosure.
Figure 6:
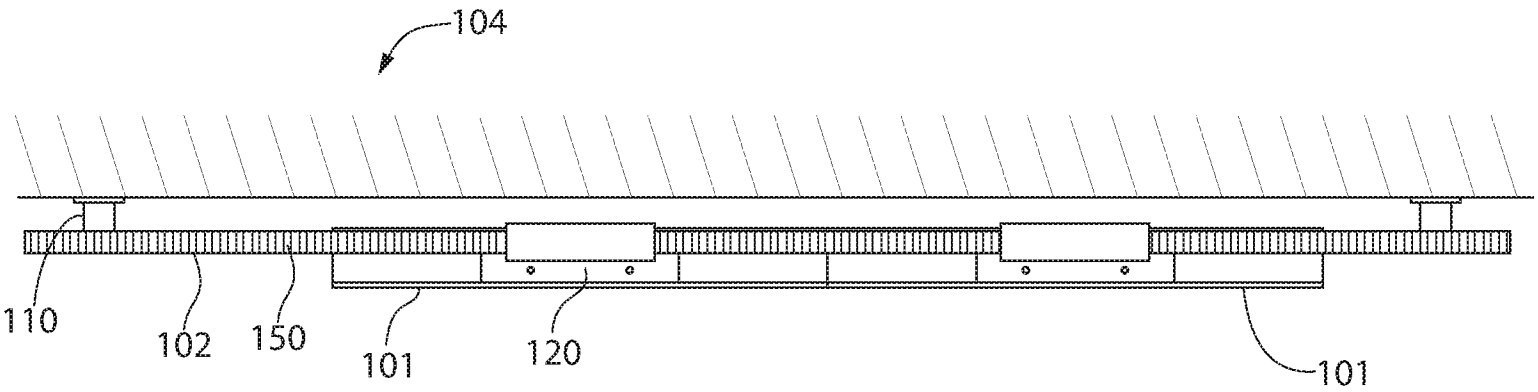
FIG. 6 is a top view thereof.
Figure 7:
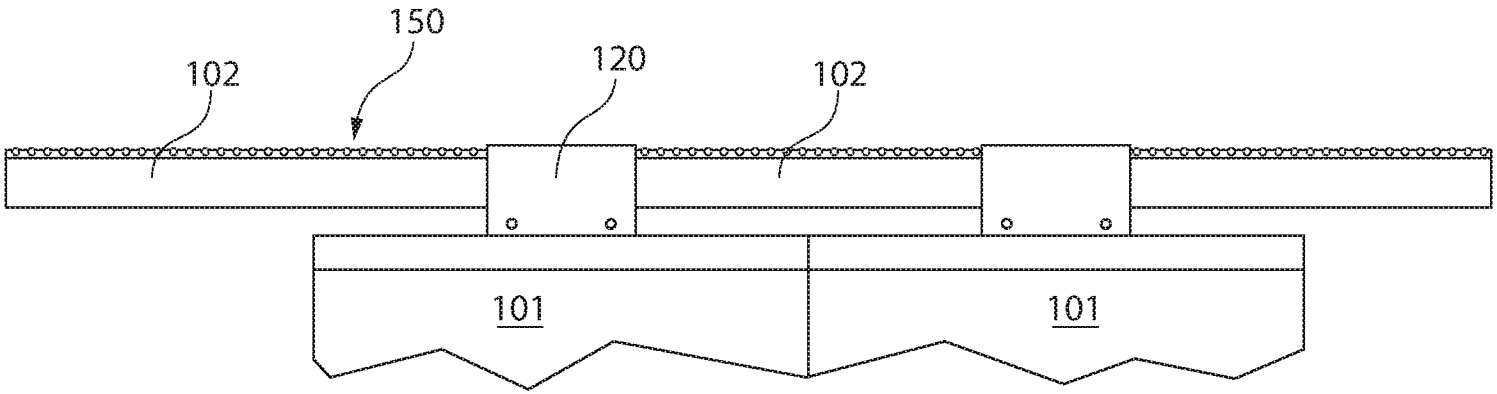
FIG. 7 is a front view thereof.
Figure 8:
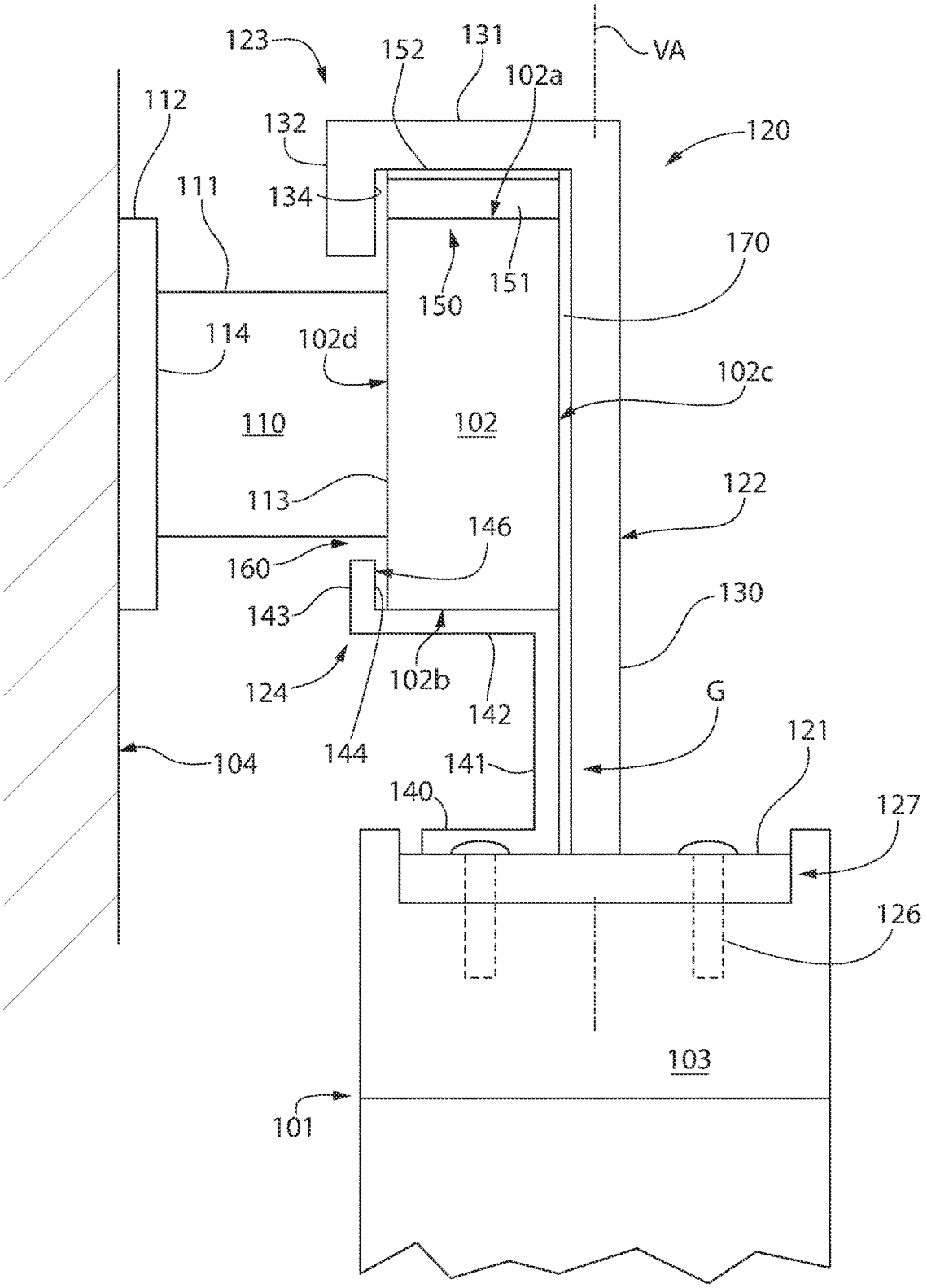
FIG. 8 is an end view thereof.
Figure 9:
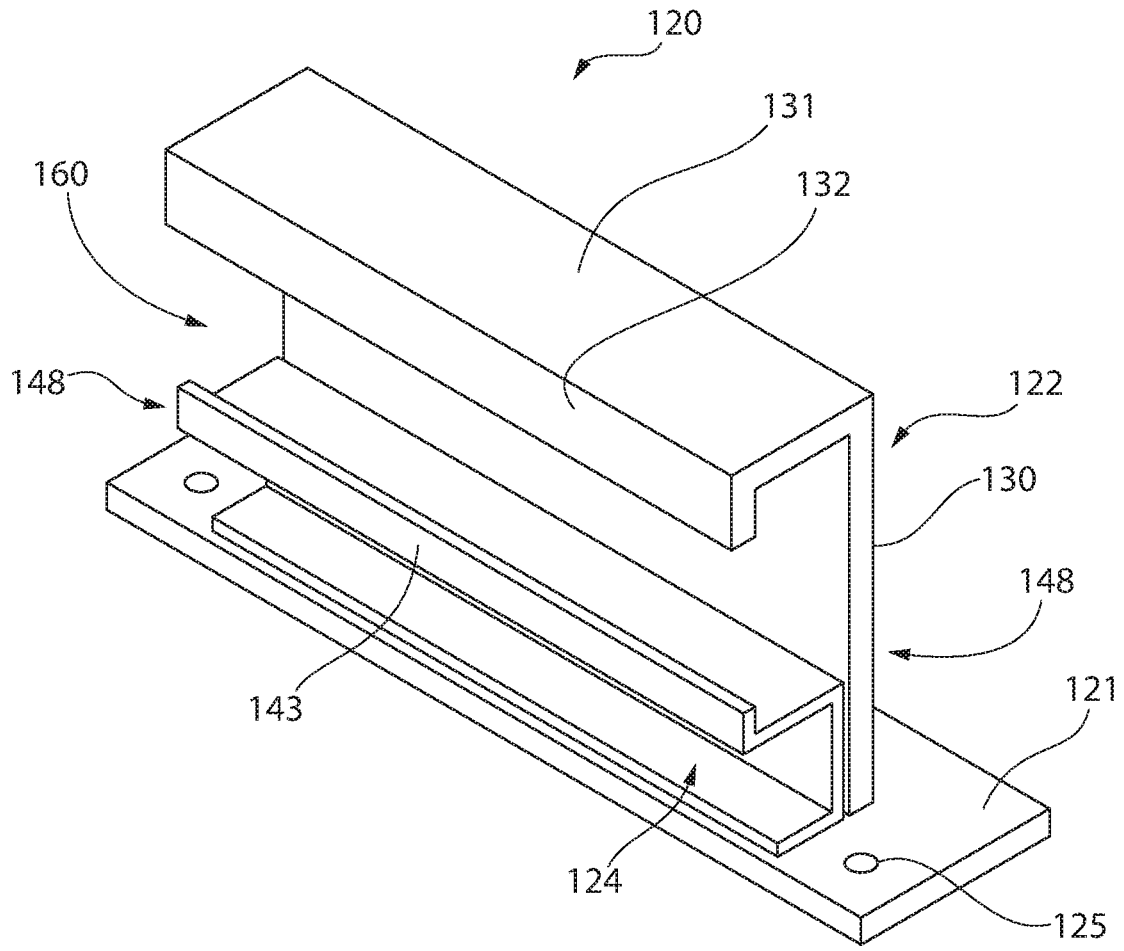
FIG. 9 is a rear perspective view of a door bracket of the door mounting systems of FIGS. 1 and 5.
Figure 10:
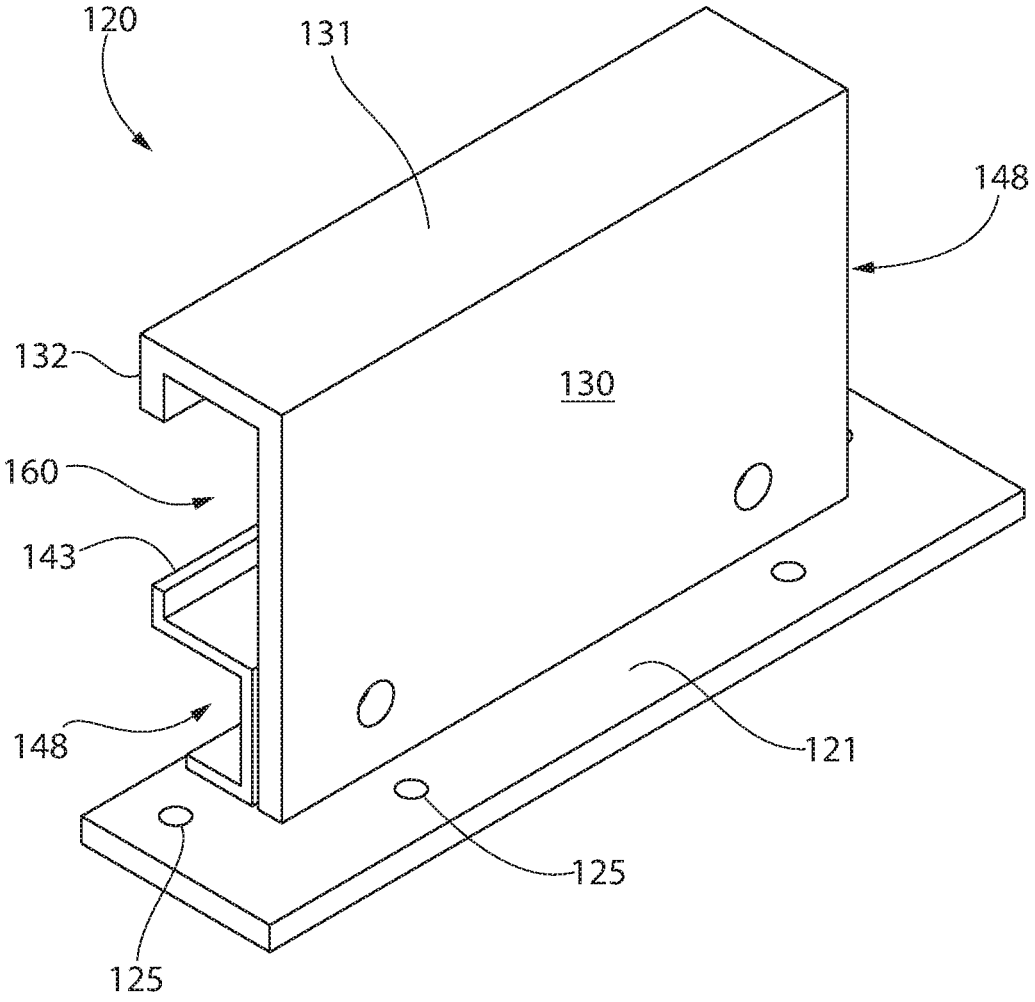
FIG. 10 is a rear perspective view thereof.
Figure 11:
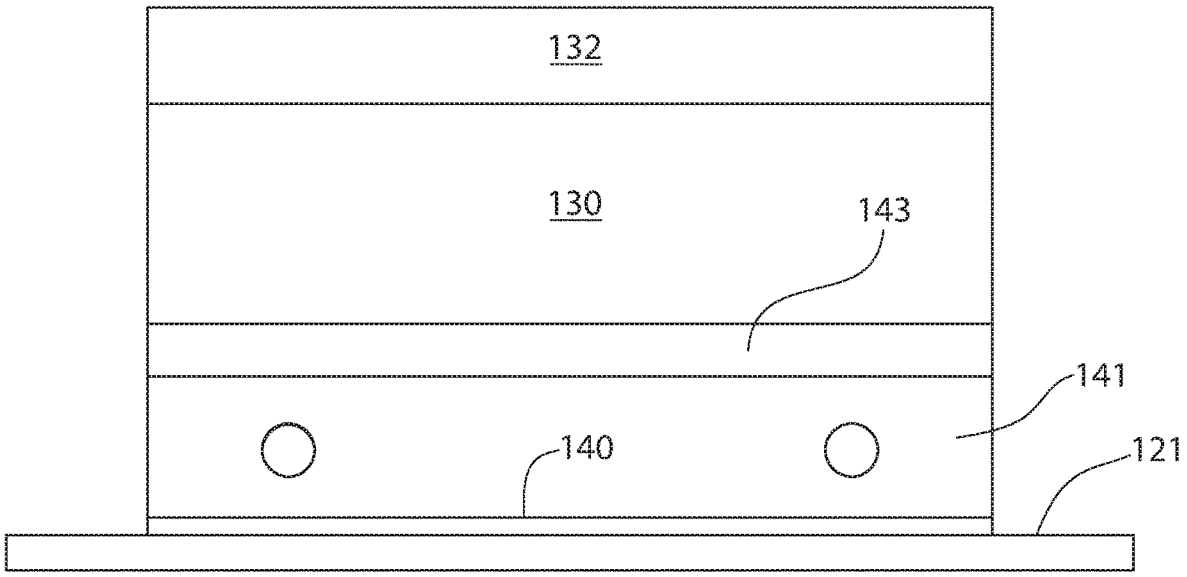
FIG. 11 is a rear view thereof.
Figure 12:
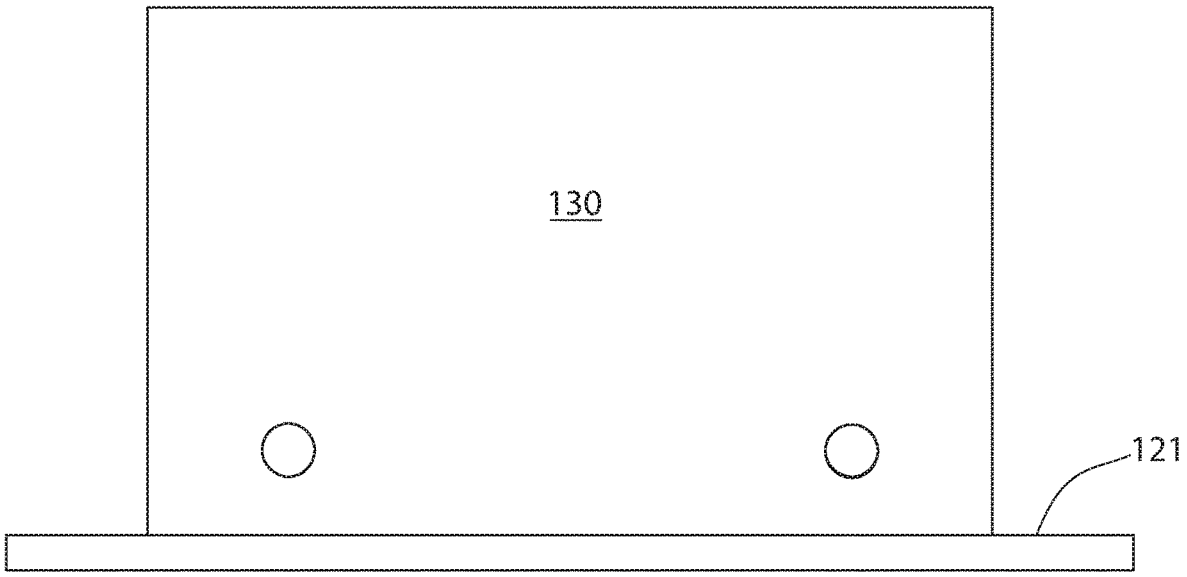
FIG. 12 is a front view thereof.
Figure 13:
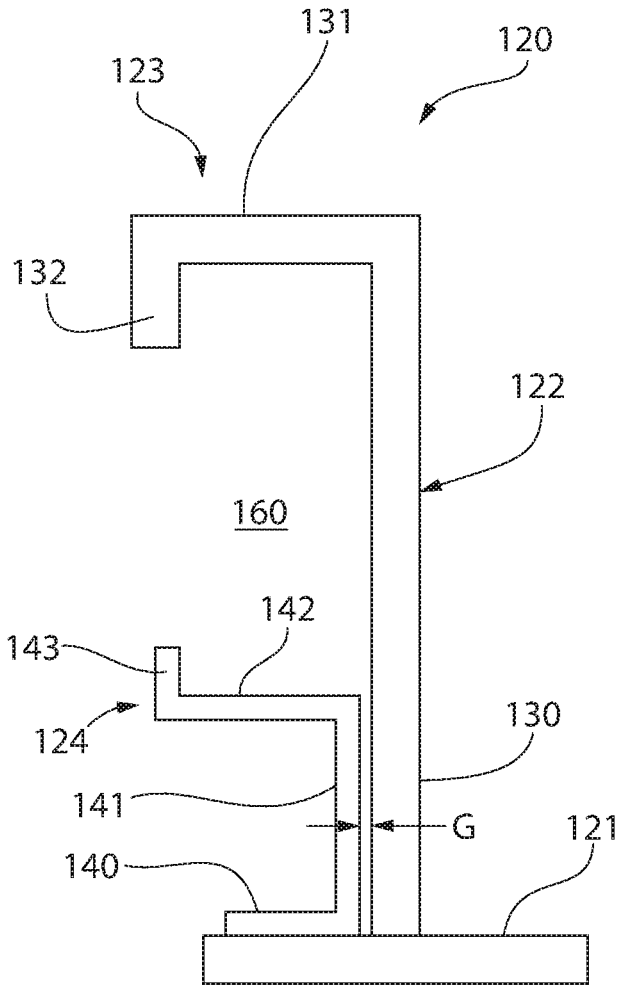
FIG. 13 is an end view thereof.
Figure 14:
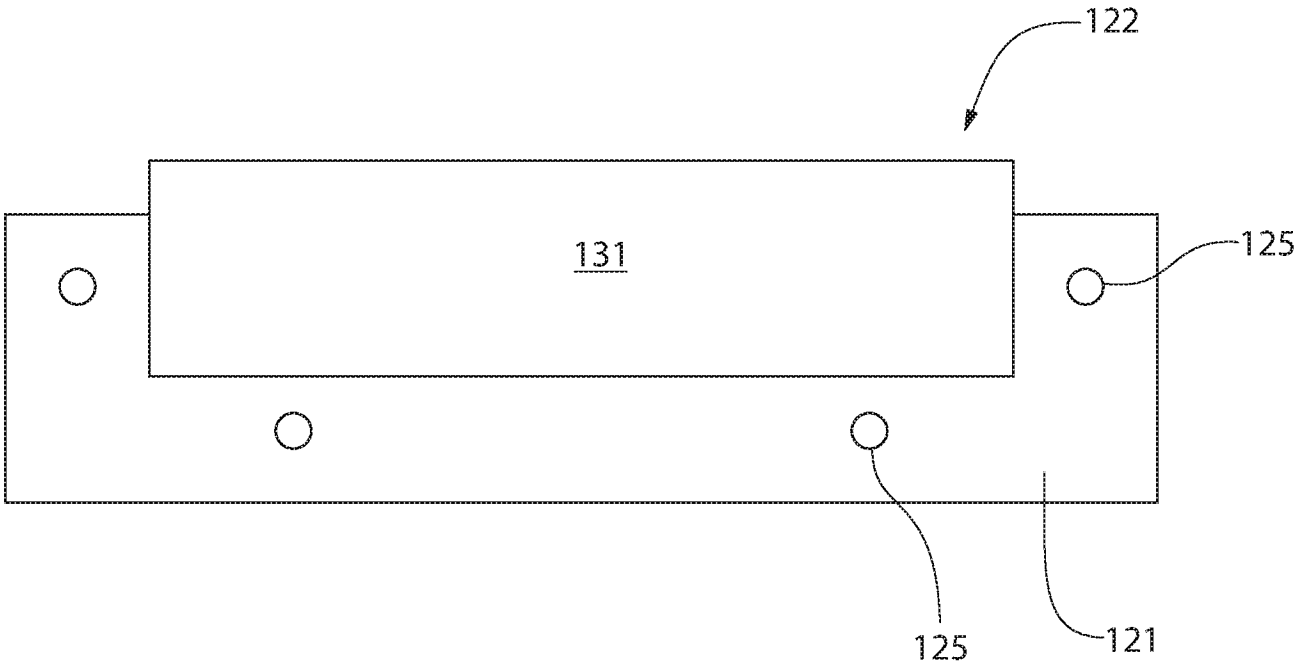
FIG. 14 is a top plan view thereof.

In one embodiment, the vertical wall section 141 of the anti-sway clip 124 may be spaced horizontally/laterally apart from the corresponding vertical wall section 130 of the hanger 122, thereby forming a gap G therebetween (see, e.g. FIG. 4). A nylon gasket 170, which may comprise a sheet of nylon in one embodiment, may be inserted in the gap to abuttingly engage the front wall of the support rail. The nylon gasket 170 provides a low friction surface arranged to slideably engage the vertical front surface 102*c* of the support rail 102 when the bracket is slid along the support rail to open/close the door. In the event the user happens to push inwardly and rearwardly on the door 101 towards the vertical support surface 104 (e.g. wall) when sliding the door thereby applying a rearward force acting in a plane transverse to the mounting axis MA of the support rail, nylon gasket 170 on hanger 122 will engage the front surface 102*c* of stationary support rail 102 ensuring smooth and quiet operation of the door. The nylon gasket 170 may extend for the full vertical height of the channel 160 in the mounting bracket in one embodiment. In some embodiments, the nylon gasket 170 may further extend along the top and first flange walls sections 131, 132 of the hanger 122 within the upper recess 134. The nylon gasket 170 may be secured to the vertical wall section 130 of hanger 122 by any suitable means such for example adhesives, fasteners, press or frictional fit, clips, fasteners, or other measures. In other possible embodiments, the nylon gasket and gap may be omitted. In yet other embodiments, a felt pad may be substituted for the nylon gasket.

The door bracket 120 and its foregoing components may be formed of a suitable metal with sufficient thickness and strength to support the weight of the door in a rigid manner without undue deformation or deflection. The door bracket may be formed of steel (including stainless steel), aluminum, titanium, or other metals. When the door mounting system will be used in environments exposed to moisture, the support rail 102, standoffs 110, and door bracket 120 may preferably be constructed of a corrosion resistant material such as without limitation stainless steel or others.

Depending on the width and weight of the door to be hung from the support rail 102, the door brackets 120 may have a length which is sufficient to allow a single bracket to be used for each door provided. In other embodiments, preferably two or more door brackets may be used for each door as needed.

The foregoing flat linear needle roller bearing 150 is disposed at an interface between the support rail 102 and the hanger 122 of door bracket 120. In one embodiment, the roller bearing 150 may be mounted within the horizontally-extending channel 160 of the door bracket 120 on the underside of the top wall section 131 of the hanger 122 as shown in FIG. 1. Accordingly, the needle roller bearing 150 is integrated into the door bracket 120 and visually concealed for both aesthetics and to avoid dust/debris accumulation which might impede operation of the rollers. The roller bearing 150 provides a combination of sliding and rolling action of the door bracket 120 along the support rail 102 for smooth operation of the door.

Figure 15:
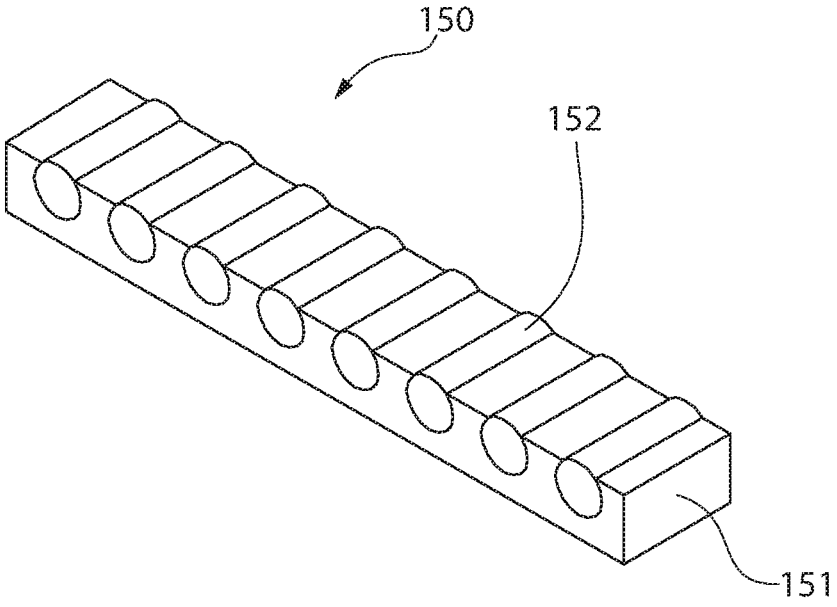
FIG. 15 is a perspective view of a linear needle roller bearing of the door mounting systems of FIGS. 1 and 5.

Linear needle roller bearings are well known and commercially available from numerous sources. FIG. 15 schematically depicts the components of a typical needle roller bearing usable with the present door mounting system. The roller bearing 150 generally includes a plurality of cylindrical radial needle rollers 152 having a low profile which are mounted in linear horizontal spaced apart relationship in an axially elongated cage strip 151 (e.g. base retainer). The needle rollers 152 are each mounted in roller pockets formed in the cage strip 151 in a manner which allows the rollers to rotate relative to the cage strip. The cage strip 151 has a straight and relatively flat and somewhat thin configuration. The case strip may preferably be formed of plastic (e.g. nylon, etc.) in one embodiment, or alternatively metal in other embodiments. The needle rollers 152 may preferably be made of a strong plastic (e.g. polypropylene, etc.) in one embodiment with a hardness capable to withstand rolling engagement with metal support rail and support the weight of the door without substantial deformation which adversely affects the ability of the rollers to rotate in the cage strip. In one embodiment, both the cage strip 151 and rollers 152 may be plastic with the hardness of the rollers being preferably harder than the cage strip. Other possible embodiments may use metal needle rollers with metal or plastic cage strips.

In one non-limiting example construction, the cage strip 151 may have a thickness less than 0.5 inches and the needle rollers 152 may have a diameter less than the cage strip. In one embodiment, the cage strip (base retainer) may be about 0.375 inches thick and the needle rollers may be about 0.25 inches in diameter. Other sizes/dimensions may of course be used. The cage strip and rollers are constructed to withstand compressive forces transmitted thereon by the horizontal top wall section 131 of the hook member 122 of the door bracket created by the weight of the door suspended from the bracket. In operation, the weight of the door is transmitted from the hanger 122 through the needle roller bearing 150 to the top surface 102*a* of the support rail (see, e.g. FIG. 4).

The needle roller bearing 150 when be mounted to the underside of the top wall section 131 of the hanger within upper recess 134 is oriented with the rollers 152 facing downwards to engage the top surface of the support rail 102 in the position shown in FIG. 4 Any suitable means may be used for attaching the cage strip 151 of the roller bearing to the hanger 122, such as for example without limitation adhesives, retaining clips, tabs, rails, etc. The manner of mounting used is not limiting of the invention. Mounting the needle roller bearing 150 on the moving door bracket 120 inside the channel 160 of the hanger 122 advantageously minimizes the length of the roller bearing needed to reduce costs. In one embodiment, needle roller bearing 150 may have a length substantially coextensive with the horizontal length of the door bracket 120.

Notably, the needle roller bearing 150 overcomes the high momentum "runaway" door problem encountered with prior suspended sliding door mounting systems noted above. In lieu of large diameter pulley or other style wheels used in the past, use of the present roller bearing 150 creates less momentum when the door is moved between the open and closed positions. This is attributable to the fact that the multiplicity of needle rollers 152 provided for the roller bearing each have a substantially smaller diameter (e.g. 0.25 inches diameter) than comparable large prior pulley style wheels previously used which thereby creates less angular momentum than large diameter wheels created by sliding the door open or closed. Typically, one or two significantly larger wheels have been provided heretofore to support the weight of the door in rolling manner. In short, the needle roller bearing 150 advantageously generates less momentum and linear velocity of the door 101 itself than prior wheeled barn-style door mounting approaches to avoid damaging the door mounting system hardware at the ends of the track and/or walls adjacent to the track.

In other possible alternative embodiments, the needle roller bearing 150 may instead be mounted to the top surface 102*a* of the support rail 102 in the position shown in FIGS. 5-8. The roller bearing 150 is oriented in this alternative arrangement with needle rollers 152 facing upwards to engage the hanger 106 (specifically, the underside of its horizontal top wall section 131). In such a configuration, the cage strip 151 of the roller bearing may have a length extending for at least a majority of, or substantially the entire length of the support rail 102 as shown. Any suitable means may be used for attaching the cage strip 151 of the roller bearing 150 to the support rail 102, such as for example without limitation adhesives, retaining clips, tabs, rails, etc. In one embodiment, a horizontally-extending channel (not shown but similar to channel 127 routed in the top of door 101 seen in FIG. 4) may be routed into the top of the support rail 102 to at least partially recess the roller bearing 150 in the rail such that the needle rollers 152 still protrude upwards beyond the top of the support rail to rollingly engage the hanger 122 (see, e.g. FIG. 8).

A method for using a door mounting system for sliding translation of the door 101 will now be briefly described. In one embodiment, the method may include: providing components of the door mounting system 100 including a longitudinally elongated support rail 102 defining a mounting axis MA, a pair of elongated wall mounts 110 rigidly attached to the support rail, a door bracket 120 including an opposing pair of open ends 148 and a rearwardly open channel 160 extending between the ends, and a linear roller bearing 150 disposed inside the channel; attaching the door bracket to a door; anchoring the support rail to a vertical support surface of a building; lifting the door with attached door bracket; inserting the support rail through the open ends of the door bracket into the channel; engaging the linear roller bearing with a top surface of the support rail; and sliding the door in one of two direction on the support rail. The method may further include the door bracket further including an anti-sway clip; applying a lateral transverse force against the hung door; and engaging a stop surface of the anti-sway clip with the support rail to arrest motion of the door in a plane transverse to the mounting axis. Variations in steps and sequence of the foregoing method are possible.

Figure 17:
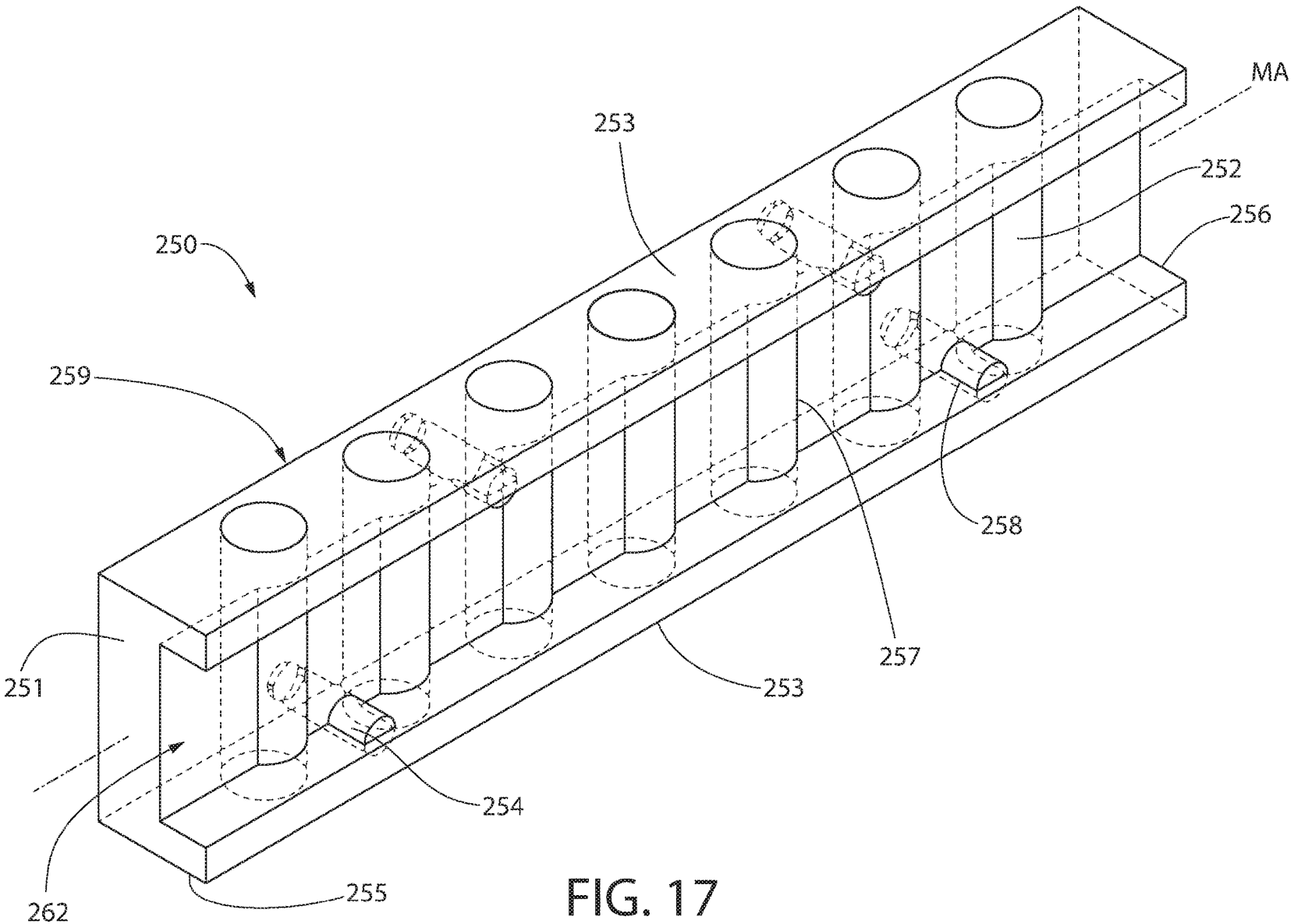
FIG. 17 is a perspective view of an alternative embodiment of a U-shaped linear roller bearing.

FIGS. 17-24 depict an alternative embodiment of a customized and modified linear roller bearing 250 usable in generally a similar manner to roller bearing 150 previously described herein. Roller bearing 250 may be mounted within the horizontally-extending channel 160 of the door bracket 120 on the underside of the top wall section 131 of the hanger 122 as shown in FIG. 17. This is a similar use and mounting arrangement to previous roller bearing 150 shown in FIG. 4.

Whereas roller bearing 150 was a generally flat bearing comprising a plurality of needle rollers 152 arranged in a cage strip 151 extending linearly in a single horizontal direction or plane, roller bearing 250 on the other hand includes a multi-directional cage strip. As seen in FIG. 4, roller bearing 150 when mounted within the horizontally-extending channel 160 of the door bracket 120 is positioned and operable to receive the vertical dead weight load or forces of the door 101 acting in a vertical direction. These forces are transmitted by the bearing to the support rail 102. By contrast, roller bearing 250 is configured to absorb both vertical and laterally/horizontally acting loads/forces by virtue of its two-way load bearing design, as described below.

Figure 24:
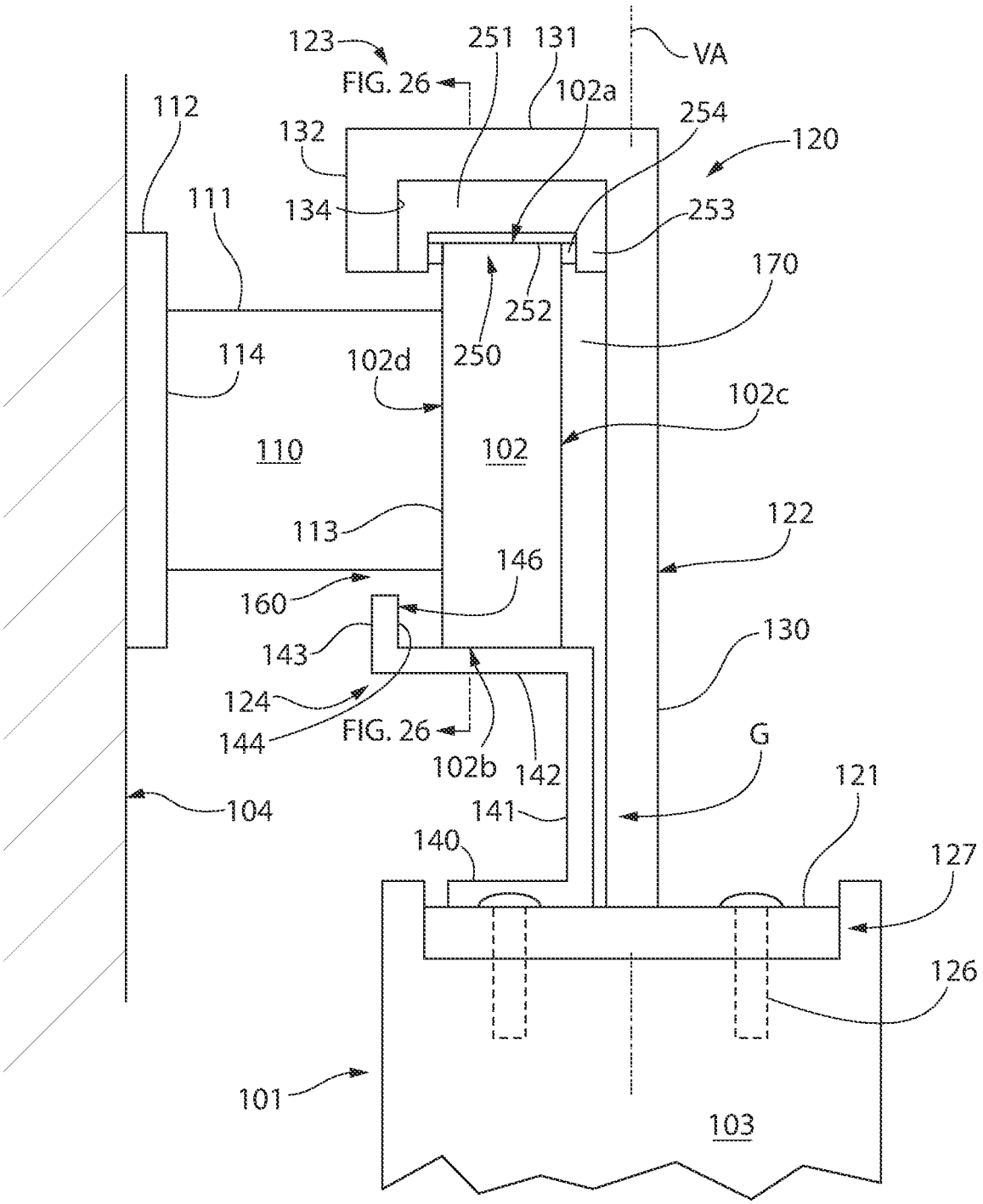
FIG. 24 is an end view of the door mounting system of FIG. 1 which alternatively incorporates the U-shaped linear roller bearing of FIG. 17.

Roller bearing 250 has a generally elongated U-shaped body which extends axially along mounting axis MA when mounted in door bracket 120 between opposing ends 255, 256. The roller bearing 250 comprises a cage strip 259 including a horizontal top wall 251 and opposing vertical sidewalls 253 projecting downwards therefrom. Sidewalls 253 are horizontally/laterally spaced apart defining a downwardly open recess 262 configured for receiving the top portion of door bracket 120 therein as shown in FIG. 24. In one embodiment, sidewalls 253 are arranged perpendicularly to top wall 251.

A plurality of cylindrical top needle rollers 252 having a low profile are mounted in linear horizontal spaced apart relationship in the elongated horizontal wall 251 of the cage strip 259 (similar to cage strip 151 and needle rollers 152 of roller bearing 150). Needle rollers 252 are horizontally oriented.

Figure 18:
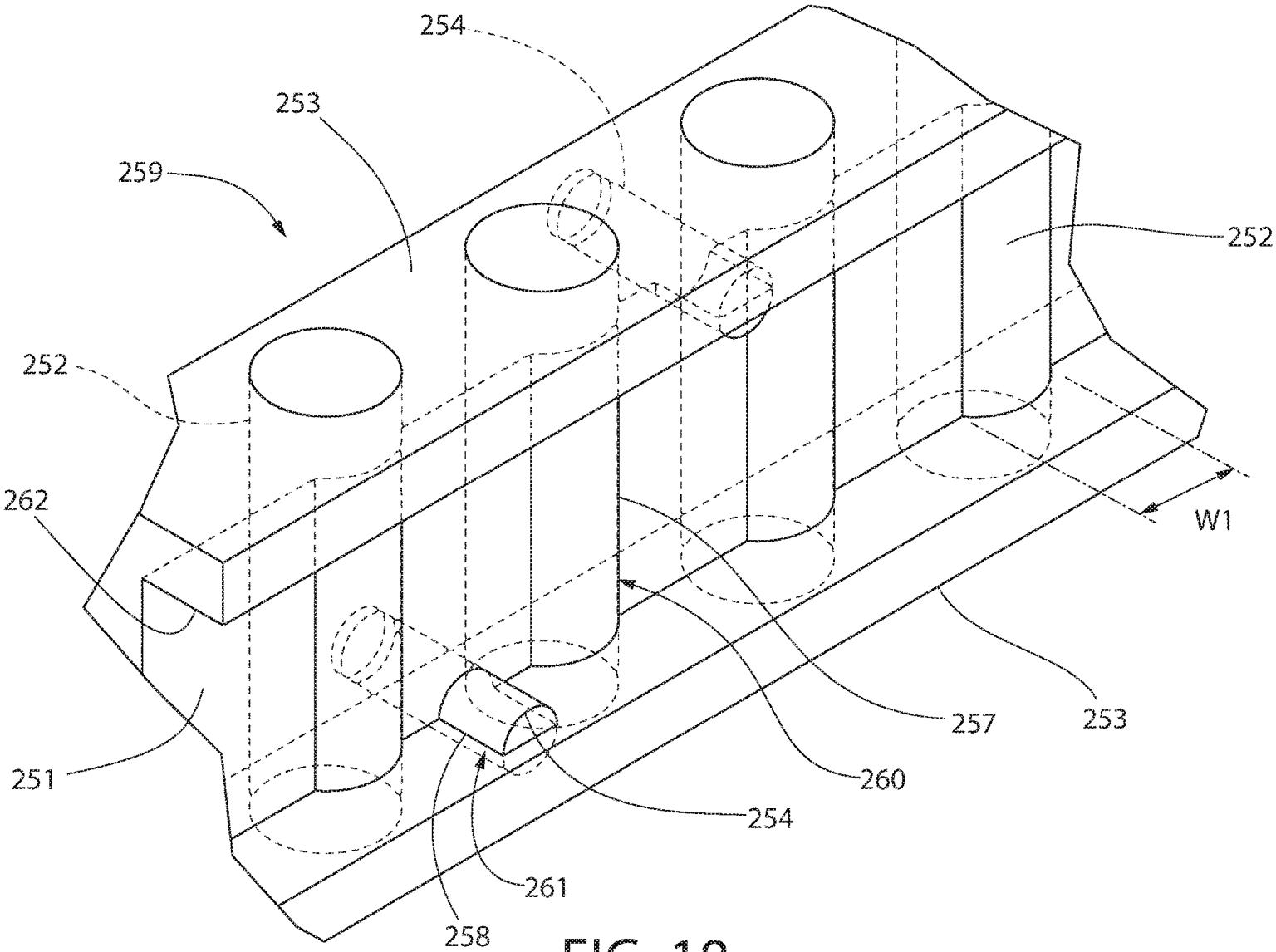
FIG. 18 is an enlarged view thereof taken from FIG. 17.
Figure 19:
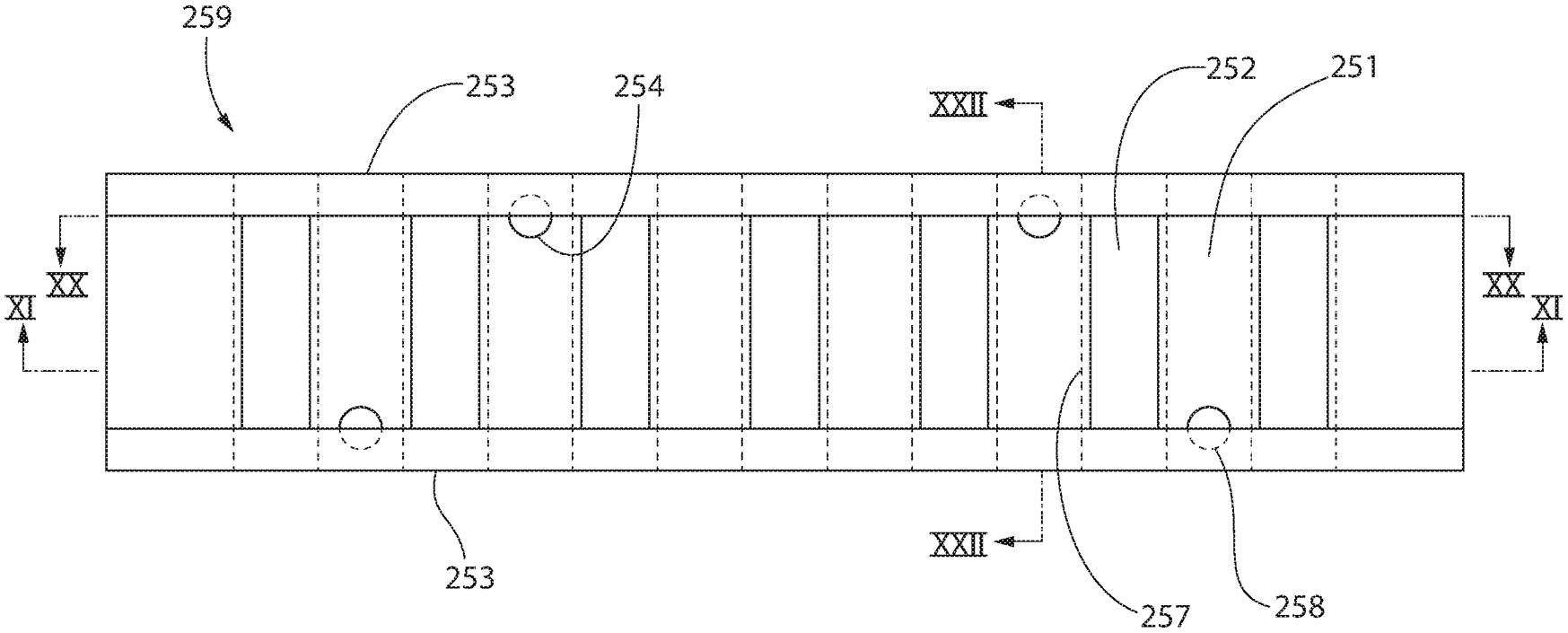
FIG. 19 is a bottom view thereof.
Figure 20:
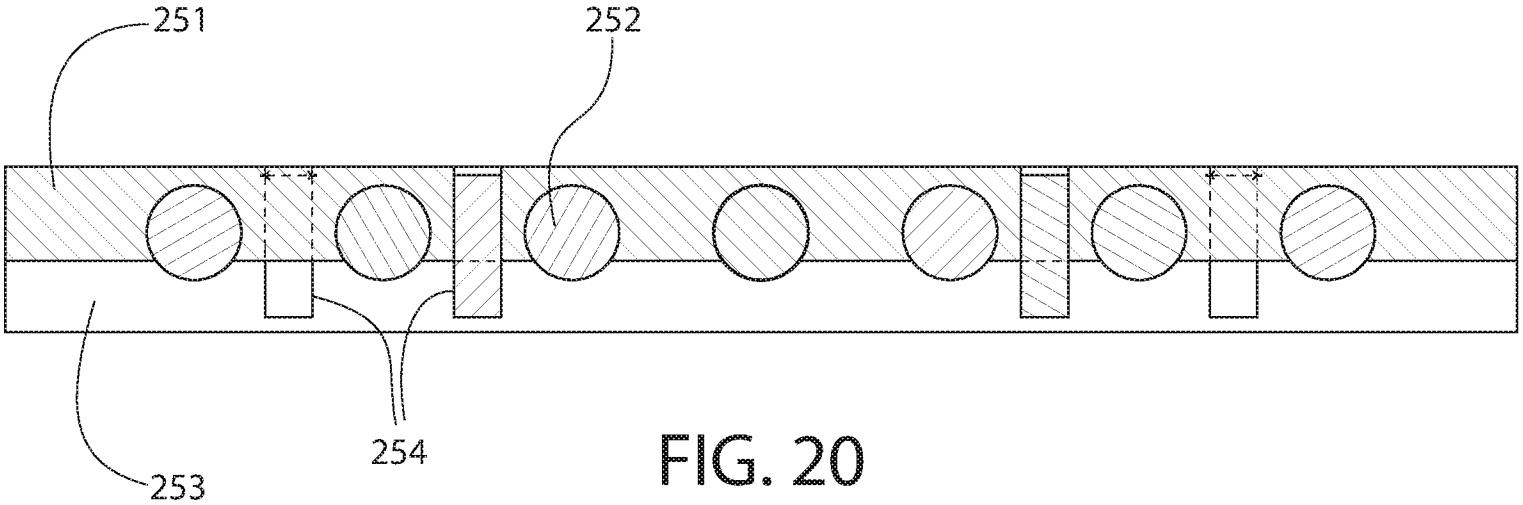
FIG. 20 is a first longitudinal cross-sectional view taken from FIG. 19.
Figure 21:
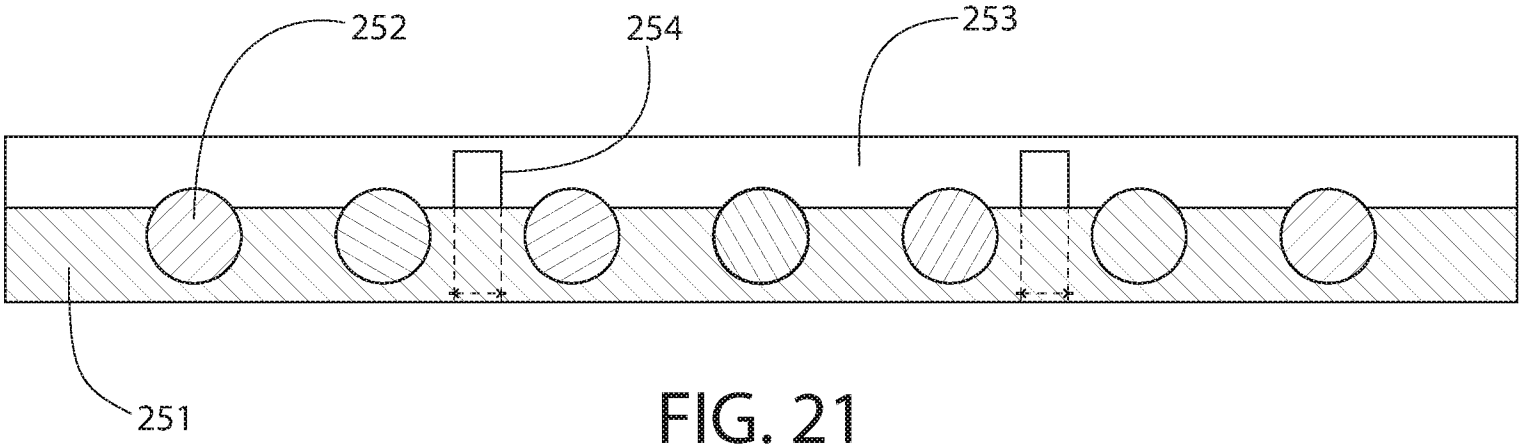
FIG. 21 is a second longitudinal cross-sectional view taken from FIG. 19.
Figure 22:
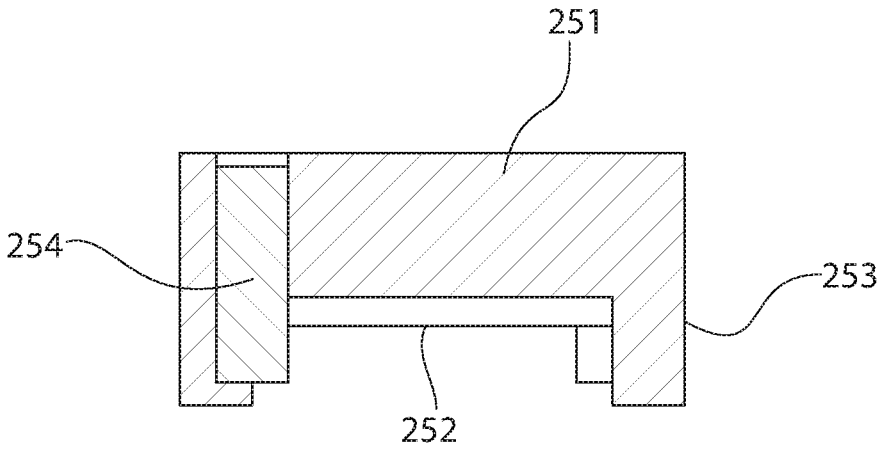
FIG. 22 is a transverse cross-sectional view taken from FIG. 19.
Figure 23:
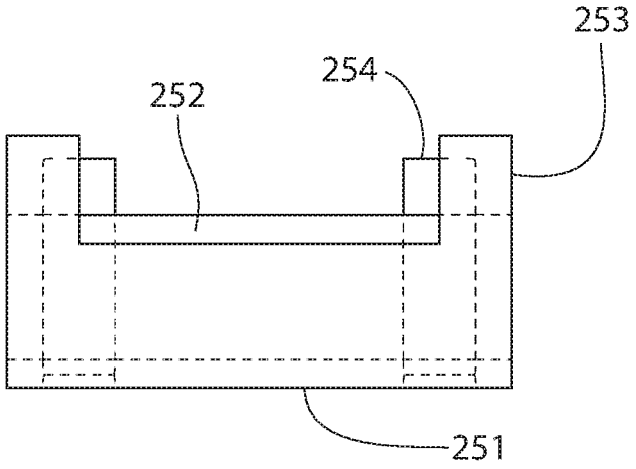
FIG. 23 is an end view of the linear roller bearing of FIG. 17.

The top needle rollers 252 are each mounted in respective complementary configured and elongated roller pockets 257 formed in the horizontal wall 251 in a manner which allows the rollers to rotate relative to the cage strip. Roller pockets 257 are arranged perpendicularly to mounting axis MA when roller bearing 250 is in a mounted position in door bracket 120. As best shown in FIG. 18, the roller pockets 257 each define elongated windows or openings 260 facing inwards towards recess 262 and through which only a portion of the diameter of needle rollers 252 are exposed and project upwards above horizontal wall 251 to rollingly engage the top surface of support rail 102 (see, e.g. FIG. 24). Openings 260 have an axial width W1 measured in the direction of mounting axis MA which is less than the diameter of rollers 252 to trap the rollers in the cage strip 259, yet allow rotation of the rollers and engagement with support rail 102.

Each of the sidewalls 253 of roller bearing 250 in one embodiment also includes a plurality of axially spaced apart and elongated lateral needle rollers 254 having a similar cylindrical configuration to rollers 252. Lateral needle rollers 254 are oriented vertically and perpendicularly to top needle rollers 252. Lateral needle rollers 254 are each similarly mounted in respective roller pockets 258 having openings 261 facing inwards towards recess 262 of the cage strip 259, and through which only a portion of the diameter of needle rollers 254 are exposed and project laterally inwards into recess 262 beyond sidewalls 253 (see, e.g. FIG. 24). Roller pockets 258 are configured to retain the rollers 254 in the cage strip in a similar manner to rollers 252. The lateral needle rollers 254 are arranged to engage the lateral side surfaces of support rail 102. In one embodiment, each sidewall 253 of cage strip 259 includes at least one pair of lateral needle rollers 254 as shown for engaging the support rail 102 (i.e. vertical front and rear surfaces 102*c*, 102*d*) at two different points of rolling contact. Advantageously, the lateral needle rollers 254 prevent rubbing and friction between the lateral side surfaces of support rail 102 and the door bracket 120 to ensure smooth rolling movement of door bracket and door 101 along the support rail during opening and closing sliding motions of the door. In addition, these lateral needle rollers 254 advantageously also resist any front-to-back swaying motion of the door at the top of support rail 102, whereas stop surface 146 formed on anti-sway clip 124 and facing inwards towards channel 160 resists any front-to-back swaying motion of the door at the bottom of the support rail 102 (see, e.g. FIG. 24). This combination of top and bottom anti-sway features advantageously enhances lateral support and resistance to swaying door motions to ensure smooth rolling of the door 102 along the support rail 102 even if the user pushes against the door while rolling it open or closed.

In other possible embodiments, only the rear sidewall 253 of roller bearing 250 in one embodiment may include a plurality of axially spaced apart and elongated lateral needle rollers 254 to arrest motion of the door in a plane transverse to the mounting axis MA if the user pushes against the door. In such embodiments, the front sidewall 253 of the roller bearing 250 may optionally be omitted in some embodiment, or alternatively retained but without lateral needle rollers 254. In yet other embodiments having only rear lateral needle rollers 254 and no front sidewall 253, such a roller bearing 250 construction may be used in conjunction with nylon gasket 170 on hanger 122 previously described herein.

To ensure the lateral needle rollers 254 are securely retained in the U-shaped cage strip 259, a portion of the roller pockets 258 and rollers 254 extend at least partially into top wall 251 of the cage strip (referring FIGS. 17-18 and 20-23). This advantageously maximizes the length of the rollers 254 while minimizing the height of the cage strip 250 to allow for a compact bearing mounting arrangement. In one embodiment, at least half of the length of rollers 254 (e.g. upper portions) may be embedded in the top wall 251 of the cage strip (see, e.g. cross section of FIG. 22). Accordingly, only the lower portion of rollers 254 are exposed in cage strip recess 262 to engage the support rail 102.

In one embodiment, the lateral needle rollers 254 may each be interspersed between the top needle rollers 252. Advantageously, this minimizes the size and profile of the cage strip 259 allowing for a compact construction. Because the laterally-acting loads or forces imparted to the cage strip 259 by the door bracket 120 bracket caused by swaying of door 101 into/out of the plane of the door are significantly less than the vertically-acting loads or forces caused by the dead weight the door, the lateral needle rollers 254 may be smaller in diameter and/or length than the top needle rollers 252 in some embodiments as shown. This further contributes to the compactness of the cage strip 259. In addition, the lateral needle rollers 254 may be smaller in number than the top needle rollers 252. In some embodiments, the lateral needle rollers 254 may spaced farther apart than the top needle rollers 252.

The case strip 259 may preferably be formed of plastic (e.g. nylon, etc.) in one embodiment, or alternatively metal in other embodiments. The needle rollers 252, 254 may preferably be made of a suitably strong plastic (e.g. polypropylene, etc.) in one embodiment to withstand engagement with the metal support rail 102 for supporting the weight of the door without deformation. Other possible embodiments may use metal needle rollers. Accordingly, any combination of metal or plastic rollers and cage strip materials may be used together. In a preferred but non-limiting embodiment, a plastic case strip 259 and rollers 252, 254 are used. The foregoing same combinations of materials may be used for roller bearing 150 previously described herein.

FIG. 24 shows the present multi-directional roller bearing 250 in a mounted position within the horizontally-extending channel 160 of the door bracket 120 on the underside of the top wall section 131 of the hanger 122. Roller bearing 250 may have a length substantially coextensive with the horizontal length of the hanger 122 (in a similar vane to roller bearing 150 previously described herein). In operation, the top needle rollers 252 of bearing 250 ride along the horizontal top surface 102*a* of the support rail 102 as the door 103 is rolled back and forth on the rail. The needle rollers 252 support the weight of the door and any attached hardware such as door brackets 120, as previously described herein. If the user happens to push and apply an inward or outward directed force acting normally to the door (i.e. towards the left or right in FIG. 24) while sliding the door axially along mounting axis MA, this will cause the door to tilt or cant out of its normal vertical hanging plane about the hanger 122 at top which suspends the door 101 from the mounting rail 102. The lateral needle rollers 254, however, advantageously provides lateral guidance for door 101 via rolling engagement with the lateral vertical front surface 102*c* and/or opposite vertical rear surface 102*d* of the support rail 102. This not only helps stabilize the door, but advantageously reduces friction between the door bracket 120 and support rail 102 to ensure smooth gliding motion of the door.

Figure 25:
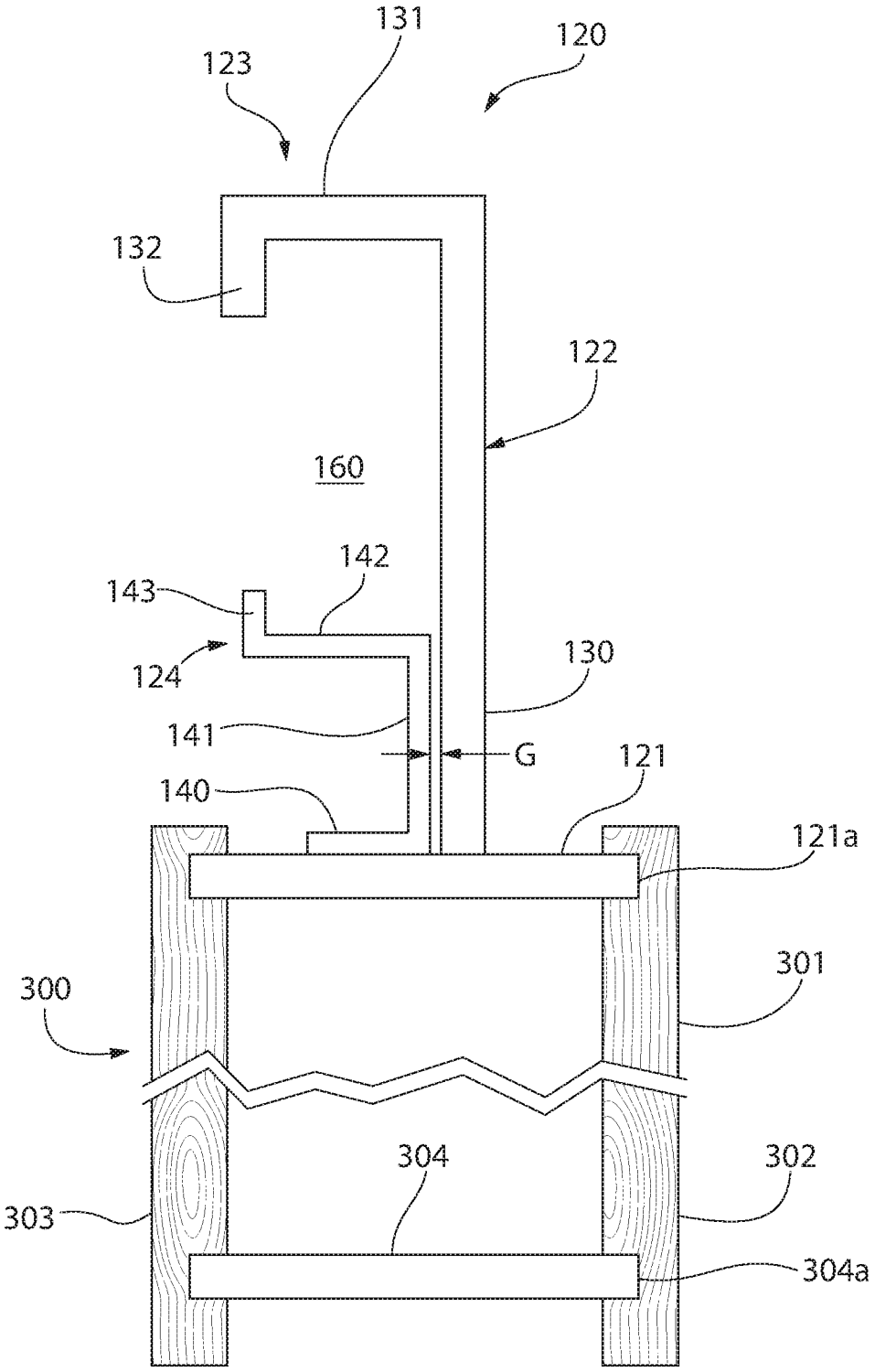
FIG. 25 is a transverse cross-sectional end view of an alternative embodiment of a mounting door bracket configured for mounting to hollow door.

FIG. 25 shows an alternative embodiment of mounting door bracket 120 configured for mounting to hollow door 300 which may lack a solid top rail 103 as described in previous embodiments. This allows a low cost and extremely light weight sliding door system to be provided. Door 300 includes substantially planar non-structural front panel 302 and rear panel 303 each of which define a major exterior surface. Panels 302 and 303 may have a solid construction and be arranged in spaced parallel relationship, thereby collectively defining a substantially hollow interior 301 of the door. The interior 301 may or may not optionally include suitable acoustic sound insulation (e.g. fiberglass, mineral wool, etc.) in some embodiments to reduce sound transference from one building space to the adjacent one. In some embodiments, the interior 301 may include a paper or fiberglass honeycomb cellular core insert comprising a plurality of open cells if added strength is desired to structurally reinforce the door.

The opposing lateral front and rear edges 121*a* of the door mount base plate 121 on the bottom of door bracket 120 are fixedly embedded in and secured within door interior 301 to the front and rear panels 302, 303. The embedment may include the use of suitable industrial adhesives in some embodiment to permanently affix the base plate 121 to the panels. Base plate 121 is positioned for mounting at the upper or top portion of door 300 as shown. It bears noting that in addition to fixing the base plate 121 of door bracket 120 to the door 300, the base plate also serves the role of structurally coupling the front and rear door panels 301, 302 together at the top of the door. To couple the panels together near the bottom of the door, an embedment plate 304 of similar construction and size to base plate 121 may be provided having front and rear edges 304*a* also embedded in the panels in similar fashion. Each of base plate 121 and embedment plate 304 may have a planar rectangular shape similar to that further shown in FIG. 9 for door bracket 120. The base plate 121 and/or embedment plate 304 may have axial widths that extend for less than a majority of the axial width of the door 300 (similar to that shown in FIG. 1 for door 101), or alternatively more than a majority of the width for firmly securing the front and rear panels together. The base plate 121 and embedment plate 304 may have the same or different widths.

Figure 26:
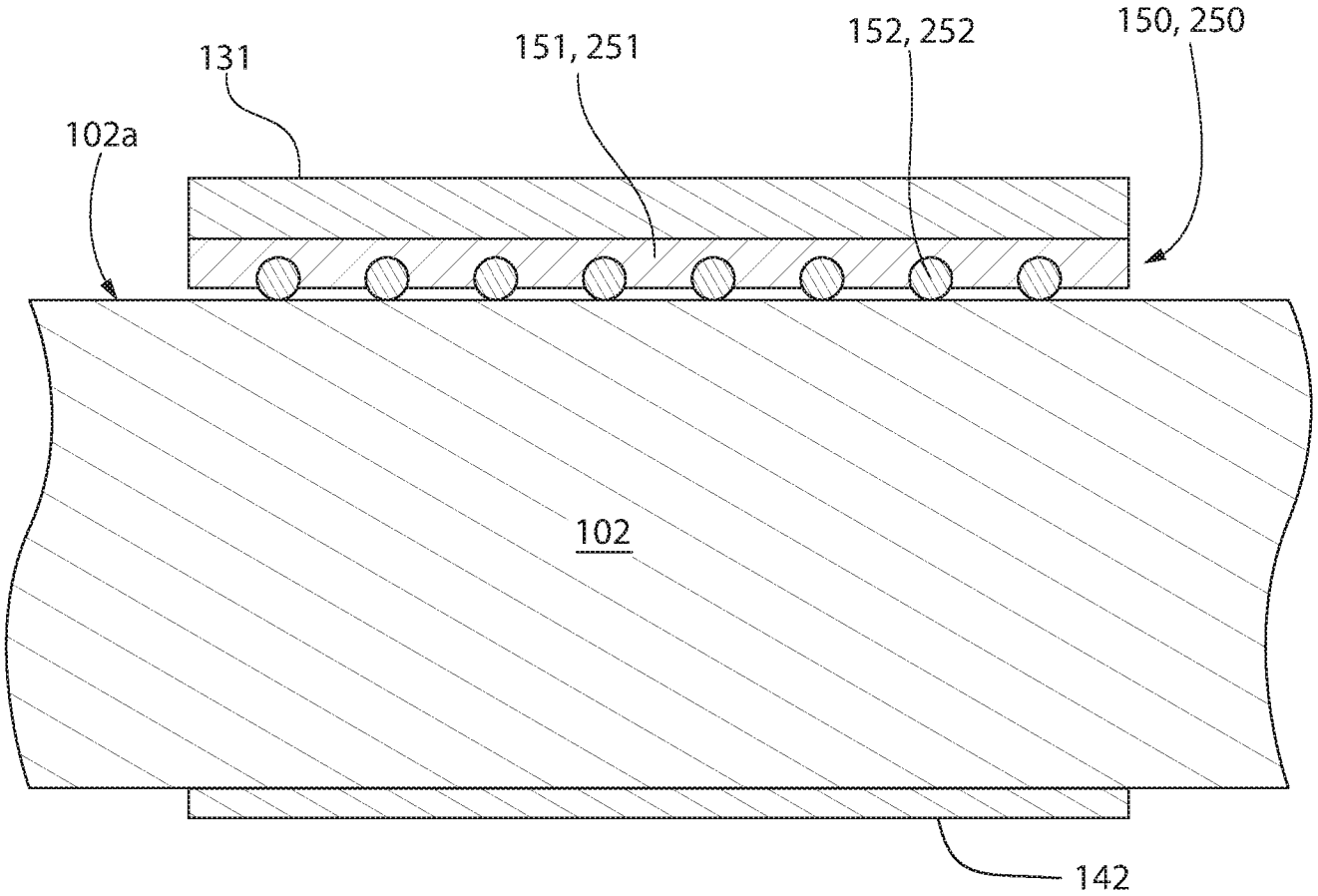
FIG. 26 is a longitudinal cross sectional view taken in FIGS. 4 and 24 as indicated which is representative of both of the linear needle roller bearings of the door mounting system assemblies of FIGS. 4 and 24 with respect to engagement of the needle rollers with the top surface of the mounting rail.

FIG. 26 is a longitudinal cross sectional view representative of both of the linear needle roller bearings 150, 250 of the door mounting system brackets of FIGS. 4 and 24 with respect to engagement of the needle rollers 152, 252 with the top surface 102*a* of the mounting rail 102. This sectional view is taken along a bisecting vertical plane as indicated in FIGS. 4 and 24 through the central portion of the roller bearings 150, 250 so that the vertical needle rollers 254 of the door hanger embodiment of roller bearing 250 is not visible in FIG. 26. As seen, the horizontal oriented needle rollers 152, 252 rollingly engage the top surface 102*a* of mounting rail 102 when the door(s) is/are operated.

While the foregoing description and drawings represent exemplary ("example") embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A door mounting system comprising:

a longitudinally elongated support rail defining a horizontally oriented mounting axis, the support rail comprising a front surface and a rear surface;

a pair of wall mounts rigidly anchoring the support rail to a vertical support surface so that the rear surface of the support rail is spaced from and faces the vertical support surface;

a door bracket movably engaging the support rail, the door bracket comprising a hanger comprising a first flange wall section facing the rear surface of the support rail along an upper portion of the support rail and an anti-sway clip comprising a second flange wall section facing the rear surface of the support rail along a lower portion of the support rail, the hanger and the anti-sway clip collectively defining a rearwardly open channel within which a portion of the support rail is positioned;

a door supported by the door bracket in a suspended manner; and a linear roller bearing disposed at an interface between the door bracket and the support rail to facilitate movement of the door bracket along the support rail;

wherein the door is linearly translatable along the support rail.

2. The door mounting system according to claim 1, wherein the wall mounts each comprise a standoff spacing the support rail horizontally away from the support surface.

3. The door mounting system according to claim 1, wherein the door bracket comprises a base plate that is coupled to a top end of the door, each of the hanger and the anti-sway clip comprising a vertical wall section that extends from the base plate, a front surface of the vertical wall section of the anti-sway clip being spaced apart from a rear surface of the vertical wall section of the hanger by a gap, and further comprising a bearing sheet positioned within the gap and extending along the rear surface of the vertical wall section of the hanger so that the bearing sheet slideably engages the front surface of the support rail during linear translation of the door along the support rail.

4. The door mounting system according to claim 1, further comprising a nylon bearing sheet disposed in the rearwardly open channel of the door bracket and slideably engaging the front surface of the support rail.

5. The door mounting system according to claim 1, wherein the wall mounts each comprise an enlarged mounting plate configured for mounting to the vertical support surface.

6. The door mounting system according to claim 1, wherein the hanger is hook-shaped and comprises a vertical wall section that faces the front surface of the support rail, a horizontal top wall section extending perpendicularly from the vertical wall and overlying a top surface of the support rail, and the first flange wall section extending perpendicularly from the horizontal top wall section so that the hanger wraps around the upper portion of the support rail.

7. The door mounting system according to claim 1, wherein each of the wall mounts comprises a shaft portion that protrudes perpendicularly from the vertical support surface, the upper portion of the support rail located above the shaft portion of the wall mounts and the lower portion of the support rail located below the shaft portion of the wall mounts.

8. The door mounting system according to claim 1, wherein the linear roller bearing includes a cage strip and a plurality of needle rollers supported by the cage strip and protruding from one side of the cage strip.

9. The door mounting system according to claim 8, wherein the hanger defines an upper recess that forms an upper section of the rearwardly open channel, the linear roller bearing is attached to the door bracket within the upper recess and oriented such that the needle rollers face downwardly to engage a top surface of the support rail.

10. The door mounting system according to claim 8, wherein the needle rollers and cage strip are each formed of a plastic material, the plastic material from which the needle rollers are formed having a greater hardness than the plastic material from which the cage strip is formed.

11. The door mounting system according to claim 8, wherein the linear roller bearing is attached to a top surface of the support rail and oriented such that the needle rollers engage a downward facing surface of the door bracket.

12. The door mounting system according to claim 1, wherein the support rail, door bracket, and wall mounts are formed of stainless steel.

13. The door mounting system according to claim 1, wherein the linear roller bearing comprises a plurality of top needle rollers and a plurality of lateral needle rollers oriented perpendicularly to the top needle rollers.

14. The door mounting system according to claim 13, wherein the linear roller bearing is U-shaped comprising a top wall and a pair of lateral sidewalls extending downwards from the top wall, the top needle rollers mounted in top wall and the lateral needle rollers mounted in each of the sidewalls.

15. A door mounting system comprising:

a longitudinally elongated support rail defining a mounting axis;

a pair of wall mounts rigidly anchoring the support rail to a vertical support surface;

a door bracket movably engaging the support rail, the door bracket including a pair of open ends and a rearwardly open channel extending between the open ends, the rearwardly open channel slideably receiving the support rail therein;

a door supported by the door bracket in a suspended manner so that an entirety of the door is positioned below the support rail; and a linear roller bearing mounted to the door bracket and disposed within an upper recess portion of the rearwardly open channel of the door bracket, the linear roller bearing comprising a plurality of needle rollers that face downwardly to engage a top surface of the support rail to facilitate movement of the door bracket and the door along the support rail;

wherein the door is linearly translatable along the support rail via rolling engagement between the linear roller bearing and the support rail, wherein the door bracket incudes a base plate attached to the door, a hook-shaped hanger attached to the base plate and having a top section extending over the top surface of the support rail, and an anti-sway clip spaced vertically apart from the top section of the hanger and collectively defining the rearwardly open channel with the hook-shaped hanger, the hook-shaped hanger and the anti-sway clip each comprising a vertical flange wall section that faces a rear surface of the support rail to retain the support rail within the rearwardly open channel, distal ends of the vertical flange wall sections of the hook-shaped hanger and the anti-sway clip being spaced apart by a gap that is configured to receive a shaft portion of the wall mounts as the door bracket slides along the support rail.

16. The door mounting system according to claim 15, wherein a rear opening of the rearwardly open channel has a height less than a height of the support rail such that the support rail cannot be laterally withdrawn from the rearwardly open channel through the rear opening.

17. The door mounting system according to claim 16, wherein the hook-shaped hanger approximates an inverted J-shape and the anti-sway clip approximates a C-shape.

18. The door mounting system according to claim 15, wherein the linear roller bearing includes a cage strip attached to a top wall section of a hanger of the door bracket and the plurality of needle rollers supported by the cage strip and protruding at least partially into the rearwardly open channel from one side of the cage strip.

19. The door mounting system according to claim 15, further comprising a nylon bearing sheet disposed in the rearwardly open channel of the door bracket and slideably engaging a front surface of the support rail.

20. A door mounting system comprising:

a longitudinally elongated support rail defining a mounting axis;

a pair of wall mounts rigidly anchoring the support rail to a vertical support surface;

a door bracket movably engaging the support rail, the door bracket including a pair of open ends and rearwardly open channel extending between the ends, the channel slideably receiving the support rail therein;

a door supported by the door bracket in a suspended manner; and a linear roller bearing disposed at an interface between the door bracket and support rail inside the channel to facilitate movement of the door bracket along the support rail;

wherein the door is linearly translatable along the support rail via rolling engagement between the roller bearing and the door bracket; and wherein the door bracket includes:

a J-shaped hook including a vertical wall section attached to a base plate and extending upwards therefrom, a horizontal top wall section extending perpendicularly and laterally therefrom, and a downward turned vertical first flange wall section extending perpendicular and downwardly therefrom, the top wall section arranged to engage a top surface of the support rail;

the base plate rigidly affixed to an upper portion of the door; and an anti-sway clip including a horizontal bottom wall section attached to the base plate of the door bracket, a vertical wall section extending perpendicularly and upwards therefrom, a top wall section extending perpendicularly and laterally therefrom in a rearward direction, and an upward turned second flange wall section extending perpendicularly upwardly therefrom and arranged to engage a lower portion of the support rail.

21. The door mounting system according to claim 15, wherein the linear roller bearing has a U-shaped body comprising a top wall and a pair of lateral sidewalls extending downwards from the top wall, the top wall including the plurality of needle rollers engaging the top surface of the support rail, and the sidewalls each including a plurality of lateral needle rollers engaging front and rear surfaces of the support rail.

22. The door mounting system according to claim 21, wherein the needle rollers, the lateral needle rollers, and the U-shaped body are each formed of a plastic material, the plastic material from which the needle rollers and the lateral needle rollers are formed having a greater hardness than the plastic material from which the U-shaped body is formed.

* * * * *